US007737930B2

(12) United States Patent
Inuzuka et al.

(10) Patent No.: US 7,737,930 B2
(45) Date of Patent: Jun. 15, 2010

(54) IMAGE SIGNAL DISPLAY APPARATUS

(75) Inventors: Tatsuki Inuzuka, Hitachi (JP); Tsunenori Yamamoto, Hitachi (JP); Akitoyo Konno, Hitachi (JP); Ikuo Hiyama, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 1243 days.

(21) Appl. No.: 11/281,385

(22) Filed: Nov. 18, 2005

(65) Prior Publication Data

US 2006/0125771 A1 Jun. 15, 2006

(30) Foreign Application Priority Data

Nov. 19, 2004 (JP) ..... 2004-335269

(51) Int. Cl.
*G09G 3/36* (2006.01)

(52) U.S. Cl. ..... 345/87; 345/76; 345/77; 345/102

(58) Field of Classification Search ..... 345/87–104, 345/208–215, 690–699, 76–77
See application file for complete search history.

(56) References Cited

U.S. PATENT DOCUMENTS

| | | | | |
|---|---|---|---|---|
| 5,424,780 | A * | 6/1995 | Cooper | 348/428.1 |
| 6,278,437 | B1 * | 8/2001 | Iga et al. | 345/598 |
| 2005/0062691 | A1 * | 3/2005 | Tamura et al. | 345/76 |
| 2008/0238843 | A1 * | 10/2008 | Yatabe | 345/87 |

FOREIGN PATENT DOCUMENTS

JP 3430998 5/2003

* cited by examiner

*Primary Examiner*—Vijay Shankar
(74) *Attorney, Agent, or Firm*—Antonelli, Terry, Stout & Kraus, LLP.

(57) ABSTRACT

A liquid crystal display apparatus that includes a liquid crystal display panel having a liquid crystal layer held between a pair of substrates, a light source whose brightness is controllable, and a normalization processing circuit that converts an image signal to a normalized signal and to a normalization coefficient. In addition, the display apparatus includes an LCD driving circuit that converts the normalized signal to an LCD driving signal for driving the liquid crystal display panel, and a light source driving circuit that converts the normalization coefficient to a light source driving signal for driving the light source. The normalization coefficient is used to set pixel values in a blanking interval of a display screen, and the normalized signal is used to set pixel values in a display area of the display screen.

7 Claims, 21 Drawing Sheets

DATA STRUCTURE

| UNIT | DATA STRUCTURE (EXAMPLE) | |
|---|---|---|
| CONTENTS, SCREEN, BLOCK, LINE, PIXEL | NORMALIZATION COEFFICIENT | n0,n1,n2,n3,n4,n5,n6,n7 |
| PIXEL | NORMALIZED SIGNAL R | r0,r1,r2,r3,r4,r5,r6,r7 |
| | NORMALIZED SIGNAL G | g0,g1,g2,g3,g4,g5,g6,g7 |
| | NORMALIZED SIGNAL B | b0,b1,b2,b3,b4,b5,b6,b7 |

IMAGE SIGNAL DISPLAY APPARATUS

BACKGROUND OF THE INVENTION

The present invention relates to the transmission method of the driving signal of a liquid crystal display apparatus.

Recently, a technology has been developed for use on a display apparatus, configured by a liquid crystal panel and a backlight, where LEDs (Light-Emitting Diode) are used on the backlight. An LED that reflects or guides light can be used as a surface light emitter of any shape and, due to its steep emission spectrum, can reproduce high-saturation colors. Another advantage is a high-speed driving control ability that allows the backlight brightness to be adjusted with the display on the liquid crystal panel.

A technology for controlling both video signals and the light source brightness is disclosed in Japanese Patent No. 3430998. For use on a liquid crystal display, this patent discloses an apparatus configuration and a method in which, with signal amplitude control unit and light source control unit, the video signals and light source brightness are controlled to maintain the average brightness for improving the contrast.

The apparatus further comprises a unit for calculating the maximum value, minimum value, and average value in a frame of received image data and a unit for measuring a change in the signals between frames in order to reduce the deterioration of signals such as flickering.

The technology disclosed in Japanese Patent No. 3430998 measures the maximum value and the minimum value of the signals in a screen, calculates the gain and the offset, and corrects the amplitude range of the input signals to use the signals as display data and to adjust the brightness of the backlight of the liquid crystal display. To do so, it is necessary to detect the maximum value and the minimum value of the signals in the screen. According to the processing procedure of the disclosed technology, all signals in a screen must be received to give the measurement result. One of the problems with the technology disclosed in Japanese Patent No. 3430998 is that the time at which the signals are measured in a screen, the time at which the signals are corrected based on the measured result, and the time at which the corrected result is output are not well synchronized. In the configuration of the apparatus shown by the drawings and the description, the screen in which the signals are measured is not the screen in which the measurement result is reflected. Because a moving image signal in the screen varies from frame to frame, the dynamic range correction according to the prior art disclosed in Japanese Patent No. 3430998 is inconsistent in principle.

SUMMARY OF THE INVENTION

It is an object of the present invention to provide an information transmission unit for use in a liquid crystal display apparatus, which controls the liquid crystal panel and the backlight, for synchronizing the liquid crystal panel with the backlight on a frame basis during the display operation.

A solution provided by the present invention is a liquid crystal display apparatus comprising a liquid crystal display panel having a liquid crystal layer held between a pair of substrates; and a light source whose brightness can be controlled, wherein the liquid crystal display apparatus further comprises means for generating an image signal with a signal for controlling the liquid crystal layer configured in a display area of a frame-based pixel configuration and with a signal for controlling the light source configured in a blanking interval of the frame-based pixel configuration.

A liquid crystal display apparatus comprises a liquid crystal display panel having a liquid crystal layer held between a pair of substrates; and a light source whose brightness can be controlled, wherein the liquid crystal display apparatus further comprises a unit for generating an image signal with a signal for controlling the liquid crystal layer and a signal for controlling the light source configured in a display area of a frame-based pixel configuration.

The liquid crystal display apparatus further comprises a unit for receiving the image signal; and a unit for separating the received signal into the signal for controlling the liquid crystal layer and the signal for controlling the light source.

The liquid crystal display apparatus further comprises a unit for converting the image signal into a serial signal.

The liquid crystal display apparatus further comprises a unit for separating the serial signal into the signal for controlling the liquid crystal layer and the signal for controlling the light source.

A liquid crystal display apparatus comprises a liquid crystal display panel having a liquid crystal layer held between a pair of substrates; and a light source, wherein the liquid crystal display apparatus further comprises a unit for storing one or more of characteristics of brightness, light emission spectrum, light emission chromaticity, light emission distribution, number of screen divisions, screen division shape, variation characteristics, and external light source characteristics in the light source; and a unit for performing signal processing for a display signal based on the characteristics.

A liquid crystal display apparatus comprises a liquid crystal display panel held between a pair of substrates and having a liquid crystal layer whose light transmittance can be controlled; and a light source whose brightness can be controlled for each of a plurality of divided areas, wherein the liquid crystal display apparatus combines the transmittance of the liquid crystal layer with the brightness of the light source to give a display output, further comprises a unit for detecting light emission distribution characteristics of the display output, and uses the light emission distribution characteristics for controlling the transmittance of the liquid crystal layer and the brightness of the light source.

The liquid crystal display apparatus wherein the light emission distribution characteristics are detected for a combination of a driving signal of each pixel of the liquid crystal layer and a driving signal of each divided area of the light source.

A liquid crystal display apparatus comprises a liquid crystal display panel held between a pair of substrates and having a liquid crystal layer whose light transmittance can be controlled; and a light source whose brightness can be controlled, wherein the transmittance of the liquid crystal layer can be controlled, M pixels at a time, the brightness of the light source can be controlled, N divided areas at a time, light emission distribution characteristics of a display output are detected, the display output being obtained by a combination of the transmittance of the liquid crystal layer and the brightness of the light source, and a transmittance control signal of the M pixels and a brightness control signal of the N divided areas are calculated using the light emission distribution characteristics.

According to the present invention, the device characteristics of both liquid crystal panel and the backlight are obtained as signals, a screen to be displayed is generated as the driving signals of the liquid crystal panel and the backlight, both signals are serially transmitted to the driving circuits of the liquid crystal panel and the backlight, and the liquid crystal panel and the backlight are synchronized for displaying an image for each frame. This gives a display output, generated by combining the device characteristics of the liquid crystal panel and the backlight, increases the number of effective display gradations, increases the contrast, and reduces the backlight power consumption.

Other objects, features and advantages of the invention will become apparent from the following description of the embodiments of the invention taken in conjunction with the accompanying drawings.

DETAILED DESCRIPTION OF THE EMBODIMENTS

Embodiments of the present invention will be described below.

The following describes the basic configuration of the present invention.

(1) General Configuration

Figure 1:
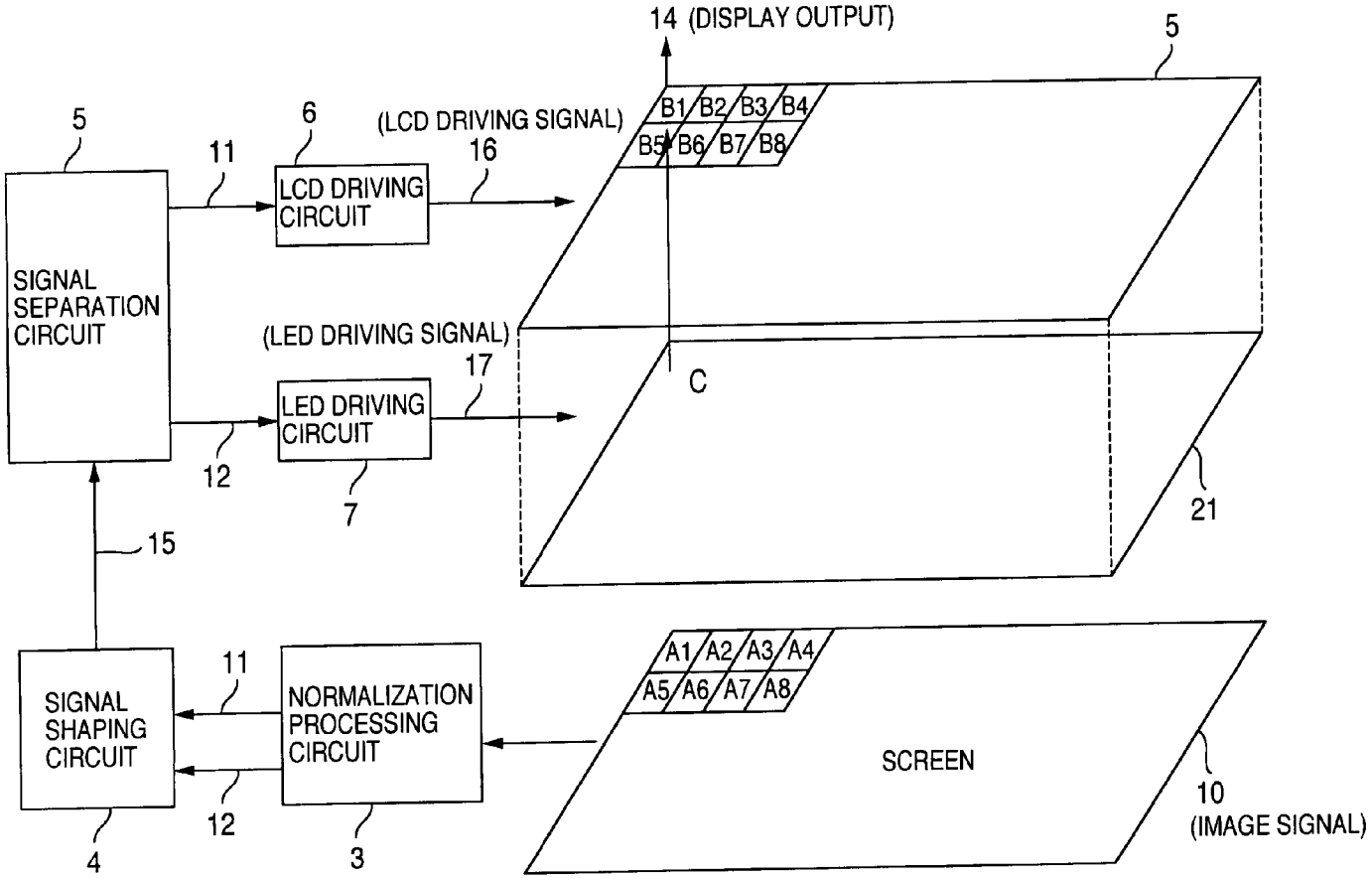
FIG. 1 is a general diagram of a liquid crystal display apparatus of the present invention.

FIG. 1 shows the basic configuration for implementing the present invention.

An exemplary configuration of a display apparatus according to the present invention comprises a liquid crystal panel 20 and a backlight 21. The liquid crystal panel 20 has multiple pixels arranged in a plane and each with a function to control the light transmittance according to the signal level. The backlight 21 is the light source of the liquid crystal panel 20. Although a cold cathode ray tube or LEDs (Light Emitting Diode) are available for use as the light emission unit, LEDs are used in the description below.

The present invention is characterized in that two types of signals are used, one for driving the liquid crystal panel 20 and the other for driving the backlight 21, to process, shape (formatting), transmit, and display the signals while maintaining synchronization between those signals on a frame (screen) basis. Note that, a frame and a screen are used equivalently and are used interchangeably in the description of the present invention.

One of the driving signals is an LCD driving signal 16 for driving the liquid crystal panel 20, and the other is an LED driving signal 17 for driving the backlight 21. Driving the liquid crystal panel 20 with the LCD driving signal 16, and the backlight 21 with the LED driving signal 17, as described above provides a display output 14 corresponding to a received image signal 10. The LCD driving signal 16 is a combination of signals transmitted to the pixels of the liquid crystal panel. Although dependent on the configuration of the backlight light emission unit, the LED driving signal is composed of three signals, one for each of RGB, if the signals are driven for the RGB (red, blue, and green) colors at a time. The present invention uses light emission unit, which can be driven on a frame (screen) basis, as the backlight 12 and gives a synchronized display output 14 using the two types of driving signals described above.

The image signal 10 is composed of a collection of pixels arranged in the plane as shown by A1, A2, etc., in the figure. The image signal 10 is a collection of digital data indicating the signal level of the pixels. The image signal 10 can be transmitted via the signal line by defining the sequence of the pixels, the sequence of bit positions, or sequence of colors in advance. The image signal 10 is converted to a normalized signal 11 and a normalization coefficient 12 using a normalization processing circuit 3. The conversion of the signals will be described later in detail. The normalized signal 11 is converted to the LCD driving signal 16 by an LCD driving circuit 6, and the normalization coefficient 12 is converted to the LED driving signal 17 by the LED driving circuit 7. Those two signals, both of which are driving signals characterizing the present invention, are equivalent and sometimes used interchangeably in the description below. The normalized signal 11 is converted to the LCD driving signal 16 by the LCD driving circuit 6, and the normalization coefficient 12 is converted to the LED driving signal 17 by the LED driving circuit 7, based on the characteristics specific to the display apparatus such as the gamma characteristics. In this way, the present invention is characterized in that signal processing is performed to increase the image quality for the normalized signal 11 and the normalization coefficient 12 or for the LCD driving signal 16 and LED driving signal 17.

Because the liquid crystal panel 20 and the backlight 21 provide the display output 14 through the operation executed by combining the two types of driving signals generated as described above, the two types of driving signals must correctly synchronize with each other on a frame basis. This requires the normalized signal 11 and the normalization coefficient 12, which are supplied from the normalization processing circuit 3 to the LCD driving circuit 6 and an LED driving circuit 7, to correctly synchronize with each other on a frame basis. The present invention is characterized in that the transmission format and the transmission unit for transmitting the normalized signal 11 and the normalization coefficient 12 on a frame basis are defined for correctly connecting signals between apparatuses.

When a serial transmission line is used between the normalization processing circuit 3 and the two driving circuits (LCD driving circuit 6 and the LED driving circuit 7), a signal shaping circuit 4 is used to convert the two types signals (normalized signal 11 and normalization coefficient 12) into a serial signal 15 for transmission. The receiving side uses a signal separation circuit 5 to separate the serial signal 15 into two types of signals (normalized signal 11 and the normalization coefficient 12). By doing so, the two types of signals are transmitted with synchronization established between them. Of course, there are many types and variations of the serial transmission line described above. For example, one physical optical fiber, one conductive wire, or wireless waves can be used. As described above, the present invention is characterized in that the signal shaping circuit 4 and the signal separation circuit 5 are provided to transmit the normalized signal 11 and the normalization coefficient 12 via a serial transmission line on a frame basis. Thus, the apparatus uses two types of signals, the normalized signal 11 and the normalization coefficient 12, to maintain synchronization between them to display high-quality images.

In FIG. 1, it is also possible to divide the backlight into areas each of which is controlled independently. In this case, the brightness must be controller as described in the embodiments.

(2) Transmission Format

The following describes the transmission format in this embodiment with reference to FIG. 2.

Figure 2A:
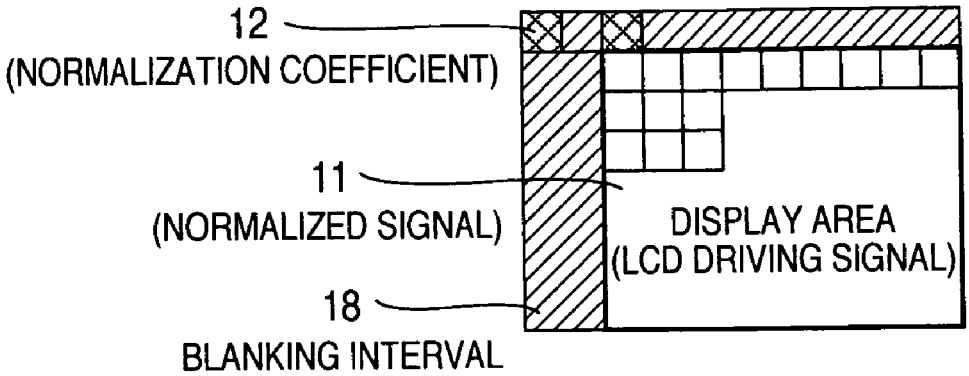
FIGS. 2A and 2B are diagrams showing the general concept of a frame of the present invention.

FIG. 2A shows the configuration in which the normalization coefficient 12 is set in the blanking interval in one frame and the normalized signal 11 is set in the display area. This configuration allows two types of signals to be transmitted without affecting the display screen. The number of normalization coefficients 12 in the blanking interval is set according to the number of divisions of the backlight. Because both the transmitting side and the receiving side must know this setting status, the format setting status is described in the signal sequence to notify it to the receiving side or a negotiation procedure is executed between the transmitting side and the receiving side prior to the transmission.

Figure 2B:
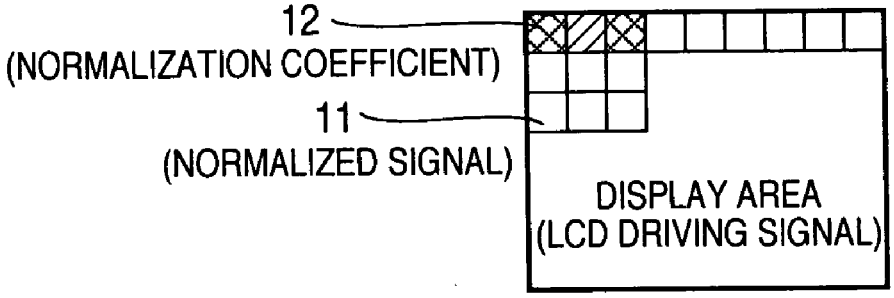

FIG. 2B shows the configuration in which the normalization coefficient 12 is set in a part of the pixels on the display screen in one frame and the normalized signal 11 is set in the remaining display area. This configuration allows the two types of signals to be transmitted simply by processing only the pixel signals in the display screen. In this case, the backlight driving signal is represented by specific pixels in the display area. Therefore, two types of driving signals are mixed in the display area. For example, in an apparatus configuration where the pixel signals can be set in the display area using an existing software program executed in a personal computer, one of the merits of this configuration is that both the normalized signal 11 and the normalization coefficient 12 can be numerically set by the software.

Although the normalization coefficient 12 is set in specific pixel positions in an example shown in the figure, those pixel positions can be set to positions that are visually difficult to identify, that is, in positions where the image quality is not affected. For example, the pixel positions in which the normalization coefficient 12 is set can be varied from frame to frame to make to make it difficult to identify them on a time basis, the signal values are distributed among multiple pixels to make it difficult to identify them on a signal amplitude basis, or those positions can be arranged in the screen as watermark information. In addition, a frame number may also be added as an auxiliary signal for making the signal control easy on a frame basis.

As shown in FIG. 2A and FIG. 2B given above, the present invention is characterized in that, during the serial transmission of the two types of signals (normalization coefficient 12 and the normalized signal 11), the normalization coefficient for a screen is transmitted before the normalized signal that is calculated using the normalization coefficient. In general, on a liquid crystal panel, the driving signal is transmitted to the pixel elements on the liquid crystal panel according to the sequence of the pixels of a received image signal. According to this invention, the light emission amount of the backlight is controlled based on the pixel driving signal transmission time. In this case, transmitting in advance the normalization coefficient that will be used as the backlight driving signal is efficient for establishing a relation between the liquid crystal panel driving time and the backlight driving time. More specifically, transmitting the normalization coefficient in advance allows the backlight to be turned on any time in one-screen period from the time the driving of the liquid crystal panel pixels is started based on an image signal of the screen to the time the next screen is driven. To describe the effect of this method, assume that the normalization coefficient and the normalized signal are transmitted in reverse sequence. In such a case, when the normalization coefficient used to drive the backlight is received, all pixels of the liquid crystal panel have already been driven and, therefore, the flexibility is significantly decreased in setting the liquid crystal panel driving time and the backlight driving time. Because the response time of a liquid crystal element is in milliseconds in time, an increase in flexibility in setting the liquid crystal panel driving time and the backlight driving time according to the present invention ensures an improvement in the image quality of the display output.

In addition to the transmission method described above, the image signal can also be transmitted via signal lines, for example, one line for each bit. The problem with a transmission line composed of multiple signal lines is that a variation (skew) in the transmission time among signal lines makes it difficult to transmit data speedily and, at the same time, such a transmission line is less compatible with the serial transmission method such as the one used for wireless waves and networks. According to the present invention, the transmission method for serially transmitting two types of signals, that is, the normalization coefficient 12 and the normalized signal 11, is defined to facilitate connection between apparatuses. The image signal transmission method according to the present invention is flexibly compatible with a combination of color signals. For example, in an apparatus configuration in which three color signals (RGB) are transmitted, the three color signals, RGB, are divided into three independent color signals. And, the normalization coefficient and the normalized signal of each color are serially transmitted to allow each color to be synchronized on a frame basis. When more than three colors (other colors than RGB) are used, a serial transmission line can be added for each color; when one type of color signal (monochrome) is transmitted, only one efficient signal line can be used for serial transmission. In this way, the apparatus can be configured flexibly according to the number of colors that will be used.

Alternatively, for well-synchronized transmission, the signal can be divided into sets of bits for serial transmission regardless of the type of color signals. For example, if 8-bit RGB color signals (a total of 24 bites) are divided into 7-bit sets, the configuration can be built in which the total of four signal lines, that is, three 7-bit signal lines and one 3-bit signal line, are used and each set is transmitted by a serial line.

Another merit of the frame-basis signal format described above is that it is compatible with the conventional frame-basis representation format of an image signal and, therefore, the conventional electrical signal lines can be used unchanged. This means that the new image signal transmission according to the present invention can be implemented using the signal transmission unit manufactured for the existing display, thus reducing the manufacturing cost and making it easy to move from the conventional method to the method according to the present invention.

(3) Normalization Coefficient and Normalized Signal

The following describes the operation of the normalization processing circuit 3 shown in FIG. 1, in which the general configuration of this embodiment is shown, and the normalized signal 11 and the normalization coefficient 12 generated during the normalization processing.

A received image signal is digital data for each pixel as described above. For example, a total of 24 bits, eight bits for each of RGB, are used to represent the digital data.

Normalization of an image signal refers to the conversion of the signal in such a way that the maximum value in an area becomes 1.0 where the area is an image area used as the unit of normalization.

Figure 3A:
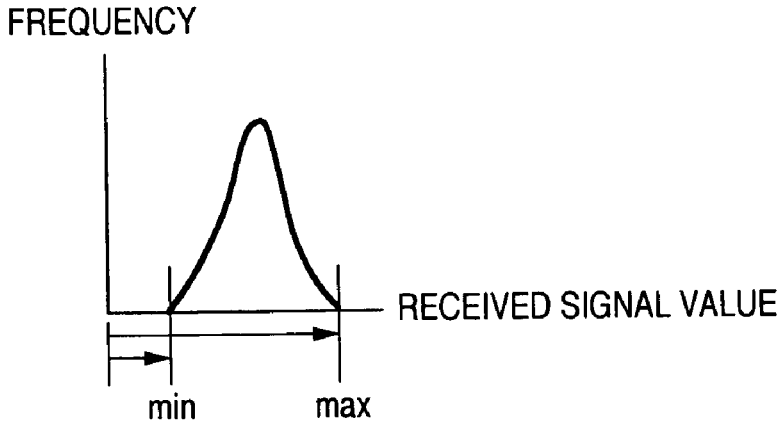
FIGS. 3A and 3B are diagrams showing normalization processing.
Figure 3B:
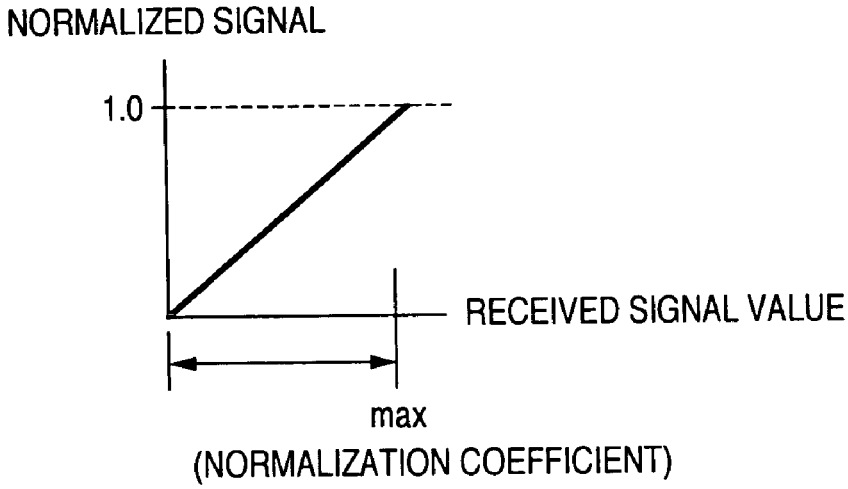

An image area used as the unit of normalization is set by the number of pixels N. In the area of N pixels, the maximum value max is obtained from the measurement result (histogram) of the input signal magnitude shown in FIG. 3A. The signal of each pixel is divided by the max, as shown in FIG. 3B, to give a decimal number with its maximum being 1.0. The result is multiplied by a number to convert it to digital data, for example, to an 8-bit binary number for use as a normalized signal. The maximum value max is used as the normalization coefficient that is the coefficient for normalization. The minimum value min of the histogram can be used as the offset described below.

The normalization processing described above is represented by the relational expression $A=F(B, C)+D$, where A is a received image signal, B is the normalized signal for one image unit, C is the normalization coefficient for N pixels, and D is the offset. The combination characteristics F represent a linear or non-linear relation with two terms, that is, B and C, as the elements. For example, when the combination characteristics F are replaced by a multiplication, the relational expression described above is expressed as $A=B\times C+D$.

In the description below, the description of image data $A=B\times C+D$ and the description of image data $A=B\times C$ are used interchangeably.

When the minimum value min in the above histogram is forced to 0 (D=0), both descriptions are apparently equivalent. Because D is a value that determines the display output (A) when no signal is generated, forcing D to 0 corresponds to the display of a black when no signal is generated without any deterioration in image quality. Therefore, both descriptions are used equivalently in the description of the present invention where they need not be distinguished.

For example, when each of B and C is represented by eight bits in the signal representation $A=B\times C$, a total of 16 bits are required. However, because the normalization coefficient C is required for each N pixels, the increase in the data amount can be set to a relatively small amount in many cases with the maximum increase in the amount of data of the whole screen being twice. For example, although the number of displayable gradations is a combination of B and C when N is the number of pixels of one screen, the amount of data of the whole screen is determined by the normalization coefficient C (eight bits for one screen) and the normalized signal B (eight bits for one pixel) and, therefore, the high image quality display output is possible by the increase in the data amount of 8/N bits. The normalized signal B and the normalization coefficient C obtained in this manner can be made to correspond to the normalized signal 11 and the normalization coefficient 12 of the display apparatus shown in FIG. 1 described above. When the whole screen is illuminated by the backlight at a time, N is the number of pixels of the whole screen. The normalized signal 11 for one pixel is used as the LCD driving signal 16 for controlling the transmittance of the liquid crystal panel 20, and the normalization coefficient 12 for N pixels is used as the LED driving signal 17 for controlling the brightness of the backlight 21. Both signals are combined to produce the display output 14.

Because N is the number of pixels of the whole screen in the above description, the unit of normalization corresponds to the operation unit of the driving circuit. Meanwhile, in the present invention, the unit of normalization of a control unit 1 and the operation unit of a display 2 can also be set differently.

The value of N that is set varies according to the configuration of the backlight. Therefore, the control unit 1 may have a unit for setting the unit of normalization. To implement this, the present invention is characterized in that storage means is provided for storing the characteristics of the display 2, such as backlight characteristics, before displaying the output.

(4) Normalization Unit

During the signal processing of the control unit 1, the unit of normalization processing can also be set regardless of the configuration of the backlight of the display 2.

Figures 4A, 4B:
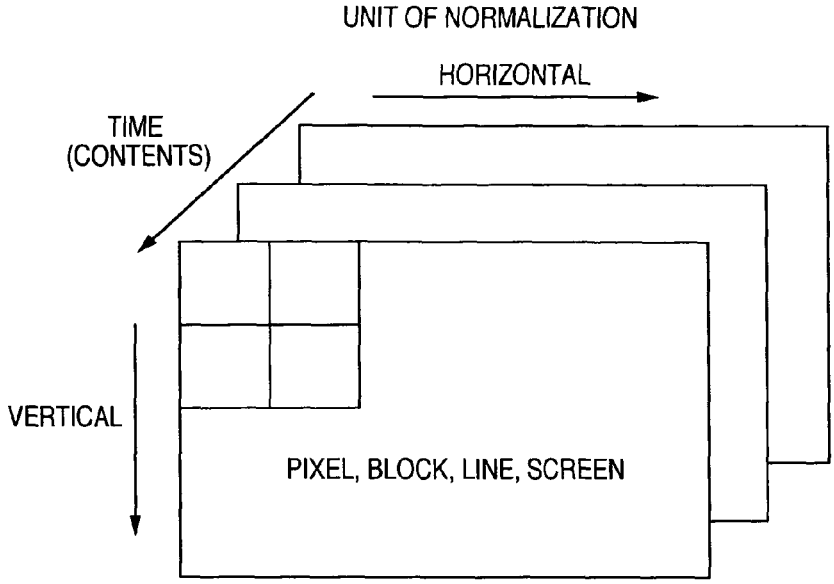
FIGS. 4A and 4B are diagrams showing the unit of normalization.

As shown in FIG. 4A, the unit of normalization processing can be any of the contents of a program (contents) in the time axis direction, a screen, a block, a line, and a pixel. FIG. 4B shows an example of a normalization coefficient and a data structure created by the normalized signal for each of RGB colors obtained through normalization processing using the normalization coefficient. The normalization coefficient is set for each unit of normalization. The normalized signal is set for each pixel using the image signal and the normalization coefficient. When one pixel is represented by three color signals (RGB), the normalization coefficient may be set for each color or for the three colors in common. In addition to both signals, additional information for identifying the normalization processing method and the data structure can also be added.

According to the present invention, the unit of normalization for the normalized signal and the normalization coefficient, obtained from the normalization processing, can be converted later. For example, when a block of multiple pixels is the unit of normalization processing, the normalization coefficient and the normalized signal obtained from the normalization processing can be converted to the normalization coefficient and the normalized signal of a unit of a larger block of multiple blocks. For example, when two blocks are integrated into one, the normalization coefficient of each block is the maximum value of the image signals included in that block and the larger of the normalization coefficients of the two blocks is the maximum value of the image signals included in the two blocks. Therefore, this maximum value is used as the normalization coefficient of the integrated block. Because the signals of each pixel can be converted back using the normalization coefficient and the normalized signal, the normalization processing can be performed again using the newly set normalization coefficient to complete the conversion of the normalization unit.

Using a similar procedure, the signal once obtained through the normalization processing of the control unit can be converted to a normalized signal based on the display characteristics of the display. Therefore, even when the characteristics of the display are unknown, a smaller number of pixels, N, can be used for normalization processing so that the normalization unit can be converted later. This reduces the dependence on the characteristics of the display. For greater versatility, the number of pixels can be set, for example, to an area of 8×8 pixels and information on the setting of the pixel area can be added as the header information. The normalized signal and the normalization coefficient thus obtained increase versatility.

It should be noted here that the normalized representation of a numeric value described above can be converted to and from the floating-point representation of the numeric value. Floating-point representation, which is a method for representing a numeric value using a combination of the mantissa and the exponent, is characterized in that the signal amplitude range can be extended while maintaining the precision of a significant digit. On the other hand, normalized representation is a method in which a reference value such as the maximum and the minimum in the signal amplitude range is used as the normalization coefficient and a result generated by normalization is used as a normalized signal. This representation is characterized in that an effective numeric value represented by the normalized signal is a value in the full decimal range from 0 to 1. While the maximum value in a block is used for normalization in normalized representation, a power of 10 (corresponds to a place in a decimal number) is used for normalization in floating-point representation where a power of 10 is the mantissa and the decimal part after normalization is the exponent. If the mantissa is set in the floating-point representation not for each pixel but for each block, both representations have a similar data structure and can be converted between them through simple signal processing. Although focus is on the normalized representation of image signals in the description of the present invention below, floating-point representation, if used instead of normalized representation, could produce an equivalent effect.

For example, floating-point representation called High Dynamic Range (HDR) is sometimes used in the data generation during computer graphics processing. However, if a signal output unit is provided only for outputting an image signal in a fixed number of bits, the image signal must be converted to data of a fixed number of bits (for example, 8-bit data) before being transmitted to the display. In one embodiment of the present invention, an apparatus for displaying a signal in normalized representation is provided as a display output unit for displaying data generated during computer graphics processing. Such an apparatus, if provided, would allow generated data to be transmitted in floating-point representation or in normalized representation, eliminating the need to convert the data to data of a fixed number of bits. On the receiving side, the signal is processed or displayed according to the display characteristics and therefore the image quality is improved. For example, the precision of gamma conversion is increased, the screen brightness can be controlled based on the maximum and minimum values of display data, and the precision of color conversion can be increased, all of which contribute to an increase in image quality. The function described above can be implemented, for example, as a function executed by the graphic board installed in a personal computer. An image signal in floating-point representation or in normalized representation is used as a signal that connects between the graphic board and the display to allow the display side to perform signal processing for the received normalized signal and the normalization coefficient and thus to display data according to the display characteristics. As a result, this method allows the generated image signal to be used on the display with no signal degradation, giving the user merit to produce a high-quality display output.

One of the problems with an image signal in floating-point representation or in normalized representation is an increase in the data amount. In particular, as the number of pixels increases and as the frame rate increases, the amount of image data increases and the data transmission rate of the signal line increases. To prevent an increase in the data amount, a well-known data compression method can of course be used. In addition, according to the present invention, the mantissa in floating-point representation and the normalization coefficient in normalized representation are shared among multiple pixels to prevent an increase in the data amount. This is implemented by utilizing a high signal correlation in the image signal in the plane direction and in the time axis direction. For example, the screen is divided into multiple blocks and, in each block, the mantissa or the normalization coefficient is represented as a single numeric value for shared use.

As compared with the numeric value representation in a fixed number of bits, the numeric representation described above can process a signal in a far wider signal amplitude range while minimizing an increase in the data amount and, at the same time, increase signal processing precision and image quality.

Here, although a unit for carrying out a transmission of the normalization coefficient is the control unit 1 and for carrying out a reception is the display 2, the configuration for the control unit 1 and the display 2 is not specifically limited. The following gives some examples.

(1) The control unit and the display are included in the same cabinet.

(2) The function of the control unit is provided in the television broadcast station and the signals described above are included as the broadcast signal to drive the display on the receiving side.

(3) The function of the control unit is implemented by a function installed in a personal computer, and the processing result is transmitted as a general video signal to drive the display.

It is of course possible to prepare a negotiation procedure that is executed before transmitting the image signal described above for confirming the capability of the control unit and the display. This negotiation procedure, a procedure provided for execution in a high level in the so-called protocol hierarchy, is executed in the application level. The procedure is a device capability negotiation procedure, such as the one used in a G3 or G4 facsimile, or a procedure coded in XML, one of markup languages, that can display the characteristics.

The example of computer graphics described above corresponds to the configuration in (3) above. The graphics board installed in a personal computer is used to generate an image signal in floating-point representation or normalized representation and to transmit the generated signal to the display.

Second Embodiment

Figure 5:
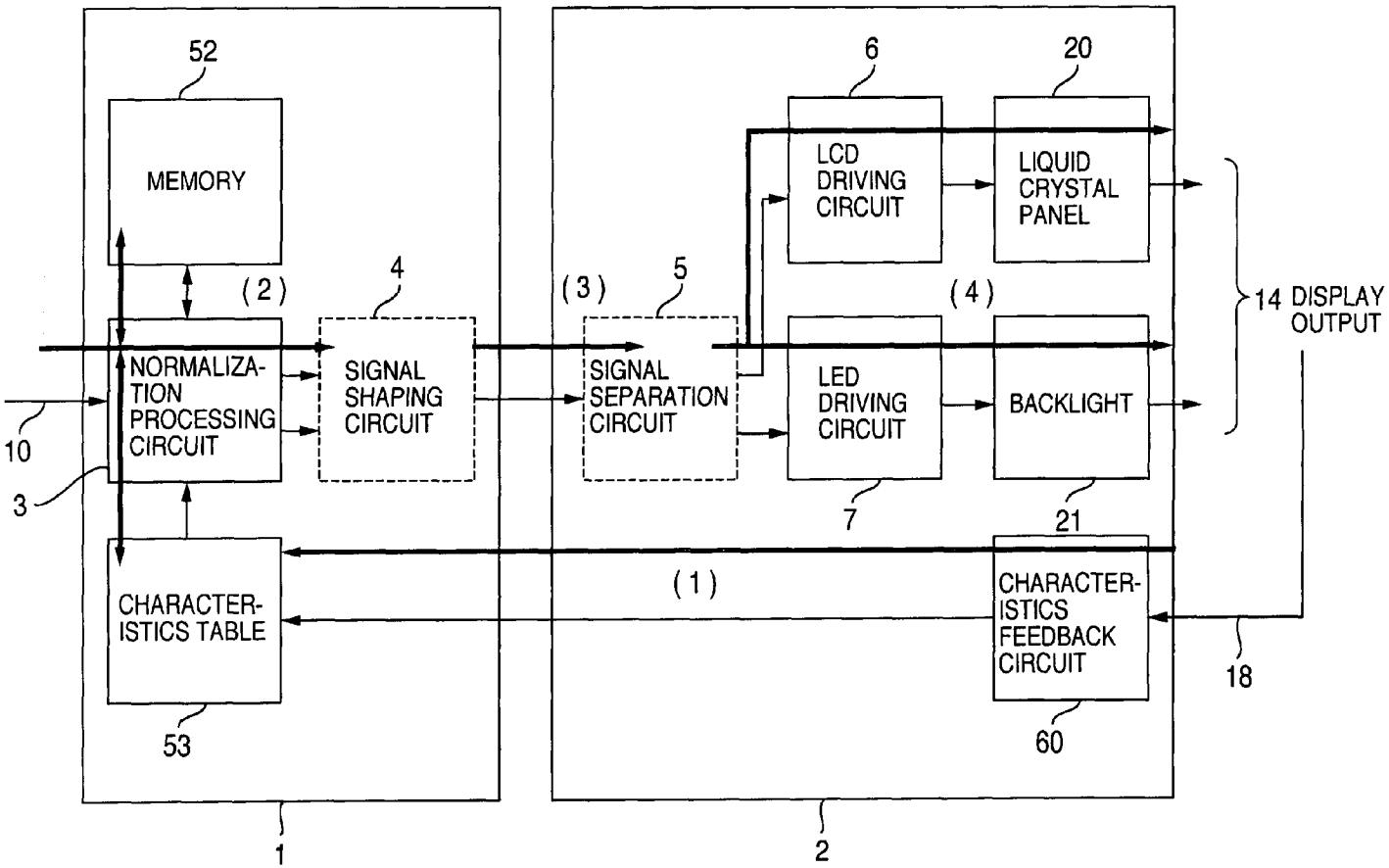
FIG. 5 is a diagram showing the general configuration of the present invention.

FIG. 5 is a diagram showing a control unit 1 and a display 2 constituting an apparatus according to the present invention. In the description below, the major signal flows indicated by bold lines are classified into four as shown by the arrows in the figure.

(1) Setting of Display Characteristics

The characteristics of the display 2 are collected as a sensor signal 18 and are transmitted to the control unit 1 via a characteristics feedback circuit 60.

The sensor signal 18 may be either a variable component collected by a sensor or static characteristics of the display 2. The sensor signal 18 is collected, and the characteristics are transmitted from the characteristics feedback circuit 60 to the control unit 1, any time, for example, when the apparatus is shipped from the factory, when the power is turned on, when the calibration operation is performed, or at a predetermined interval of time. The collected and transmitted characteristics data, stored in a characteristics table 53, can be read any time.

(2) Normalization of Received Image Signal

The control unit 1 receives the image signal 10 and converts it to a normalized signal 11 and a normalization coefficient 12 using a normalization processing circuit 3 based on the characteristics of the display 2. The normalization processing circuit 3 uses the characteristics data read from the characteristics table 53. The normalization processing circuit 3 can use a memory 52 to execute the signal processing procedure.

(3) Signal Transmission after Normalization Processing

To transmit two types of signal, that is, normalized signal 11 and normalization coefficient 12, with synchronization established on a frame basis, a signal shaping circuit 4 is used to format the signal for transmission. According to the present invention, any form of a physical transmission line can be used for signal transmission, including a conductive wire, an optical fiber, or electric waves.

(4) Driving of LCD and LED

The display 2 uses a signal separation circuit 5 to analyze the format of the received signal and separates the received signal into the normalized signal 11 and the normalization coefficient 12 for each frame. The normalized signal 11 is sent to a liquid crystal panel 20 via a LCD driving circuit 6 for driving the liquid crystal panel 20, and the normalization coefficient 12 is sent to a backlight 21 via a LED driving circuit 7 for driving the backlight 21. The display 2 outputs a display output 14 as a combination of the both.

The present invention is implemented by combining the four signal flows described above. The signals may flow at the same time, on a time-serial basis, or asynchronously.

Third Embodiment (1) Backlight, Display Panel, and Normalization

The following describes light emission unit constituting the backlight of a display, with emphasis on the configuration of an apparatus that emits light in a plane using solid light emitting elements such as LEDs.

Figure 6:
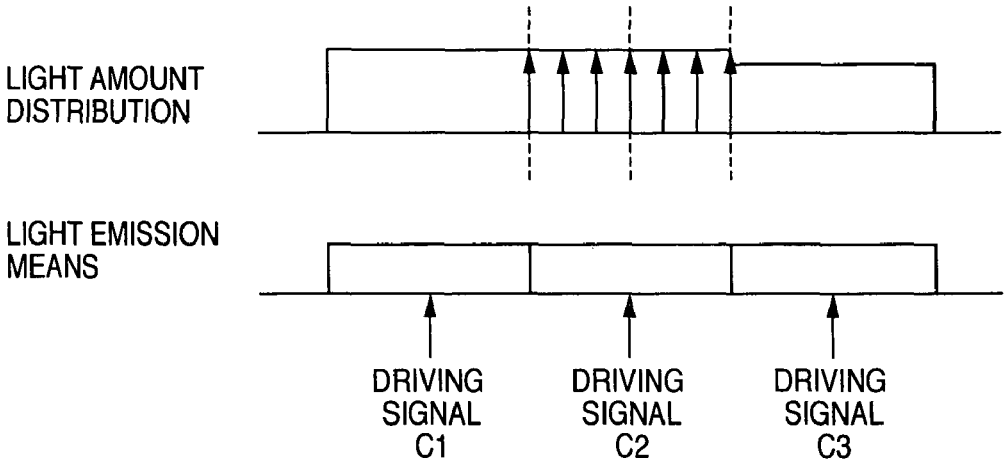
FIG. 6 is a diagram showing a light emission distribution (1).

FIG. 6 is a diagram showing the cross section of the configuration in which three light emission unit are arranged. For simplicity, assume that the light emission unit are arranged with no space between them and that light emission unit each emit the same amount of light in the corresponding in-plane area. Then, supplying the driving signal individually to each light emission unit produces a light emission distribution according to the step function. Because the area of light emission distribution by each light emission unit is in general larger than one pixel area of the liquid crystal panel, one light emission unit of the backlight illuminates multiple pixels of the liquid crystal panel at the same time. This pixel area corresponds to the unit of normalization described above. The amount of light emission by the light emission unit corresponds to the normalization coefficient, and the transmittance of a pixel of the liquid crystal panel corresponds to the normalized signal.

When both the light emission unit of the backlight and the pixels of the liquid crystal panel are driven, the light emission distribution of the light emission unit and the transmittance of the pixels are combined to give a display output.

Although the configuration method of the light emission unit depends on the type of the backlight, the characteristics of the light emission unit can be represented by preparing, in advance, information on the number of screen size divisions of the screen, the number of pixels in a divided area, and the size of a divided area. The light emission distribution, which is a correspondence relation between the in-plane position and the light emission amount, can be represented in a table format or by a function approximation. Although the light emission unit such as a LED has the standard emission wavelength characteristics, the light emission wavelength may vary according to each chip and, in addition, the light emission wavelength characteristics may vary as the fabrication technology progresses. The representation of the wavelength characteristics may vary according to the use of the emission wavelength and, therefore, the wavelength characteristics may be represented only by the peal wavelength where only the representative wavelength characteristics are required. The characteristics information on the light emission unit is stored in the storage unit adjacent to each light emission unit so that the information can be read from the storage unit. Alternatively, a database can be referenced via a communication line such as the Internet to read the detailed characteristics information for use in signal processing.

Figure 7:
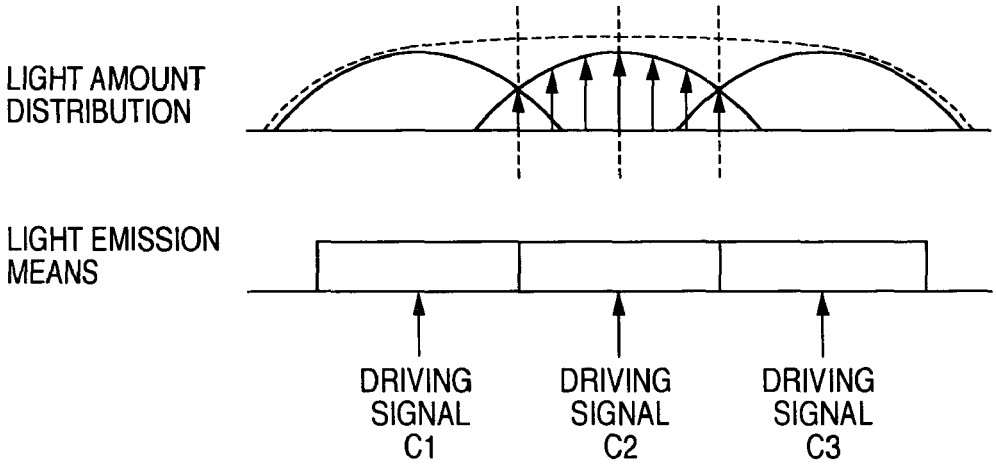
FIG. 7 is a diagram showing a light emission distribution (2).

FIG. 7 is a figure showing the cross section of the backlight configuration with three light emission unit where there are leak characteristics in the light emission distribution between the areas of the light emission unit.

In general, it is difficult to exactly match the boundary of a divided area of the light emission unit with the boundary of the pixels in the liquid crystal panel because it requires high assembly-position precision. In addition, because it is also difficult to set the distance between the liquid crystal panel surface and the backlight surface to 0, an oblique emitted light is generated in the space between the two surfaces. Due to the above problems, the light emission amounts of the light emission unit of the backlight are not even among the in-screen areas of the light emission unit and, at the same time, a light emission distribution leak is generated in the areas of the neighboring light emission unit. This light emission distribution leak makes it difficult to independently control individual light emission unit. However, a smoother and larger light emission leak allows the light emission amount in the area boundary to change more gradually and, therefore, exact precision in the assembly position between the liquid crystal panel and the backlight is not required.

Therefore, in a configuration according to the present invention where multiple light emission unit are combined to configure the backlight, a light emission distribution leak between divided areas is allowed to correct a light emission distribution leak generated by the signal processing and to eliminate the need for exact position precision in the assembly process. To correct a light emission distribution leak, the light emission characteristics including the leak are first measured and then the measured values are stored in the storage unit so that the stored light emission characteristics can be read during signal processing. Because the leak characteristics depend on such factors as the combination of the light emission unit and the LCD panel, the in-plane positions, and so on, it is desirable to measure not only the characteristics of the light emission unit but also the characteristics of the liquid crystal panel and the backlight that are assembled.

In principle, both a combination of all operations of all light emission unit of the backlight and the light emission amounts in all pixel positions on the liquid crystal panel are measured. That is, according to the principle-based measurement procedure, the driving signal is supplied to each light emission unit and the amount of light illuminated on the in-screen pixel is measured. The measurement result is represented in a table format. From this table, a measurement value is output in response to a condition that is a combination of the driving signal of each light emission unit and the position of a measured pixel.

The principle-based measurement procedure described above and the size of the table in which the measurement results are stored are not practical because the number of combinations is huge.

According to the present invention, the amount of necessary data can be reduced greatly in various ways considering such factors as the similarity in the light emission unit characteristics, the individual light emission unit, the symmetry in light emission distribution, or the function similarity in the light emission unit characteristics.

Although the description is omitted, it is of course possible to combine the light emission unit of three colors (RGB) for controlling the light emission wavelength and to measure the light emission characteristics as in the above example. In addition, elementary colors other than RGB can be combined for use.

(2) Light Emission Distribution Characteristics

Because the light emission distribution characteristics of the light source unit are very important in the present invention, the light emission distribution characteristics must be collected first. The following gives an example of a measurement unit and a measurement method for the light emission distribution characteristics. The measurement can be made any time, that is, when the specification of the apparatus is set, when the apparatus is assembled, when the apparatus is shipped from the factory, or at any time after the installation. Although, in practice, a combination of light source colors (such as red, blue and green) is measured and the result is obtained, only the brightness signal is collected for simplicity in the description below.

Figure 8:
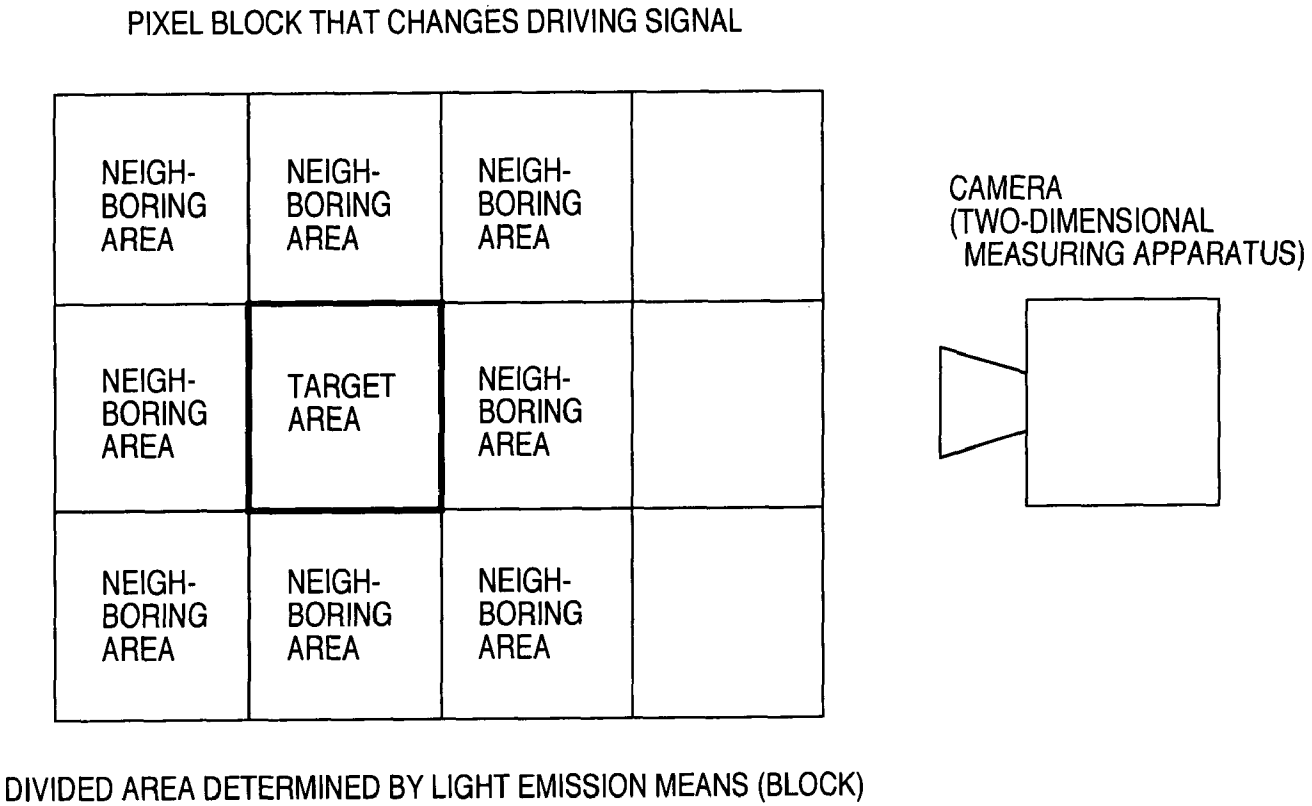
FIG. 8 is a diagram showing an apparatus configuration for measuring distribution characteristics.

FIG. 8 is a diagram showing the apparatus configuration for measuring the characteristics of a display configured by a combination of a backlight and a liquid crystal panel. The most basic measurement method is to measure the display output in all pixel positions for all combinations of two driving signals (that is, backlight driving and liquid crystal panel driving signal).

Meanwhile, if the characteristics of the light emission unit of the backlight are equal, the light emission amount in a position in the backlight can be calculated as the accumulation value of the amount of light emission from each light emission unit. Therefore, in this case, it is only required to measure the light emission distribution of one light emission unit.

(3) Backlight Characteristics

If the light emission distributions of the light emission unit included in a combination of multiple light emission unit constituting a backlight are the same, only the representative light emission distribution characteristics are stored in the storage unit. The light emission amount in the pixel position is read from this storage unit and the light emission amounts of the light emission unit are added up to calculate the light emission amount of the backlight in the pixel position.

Figure 9:
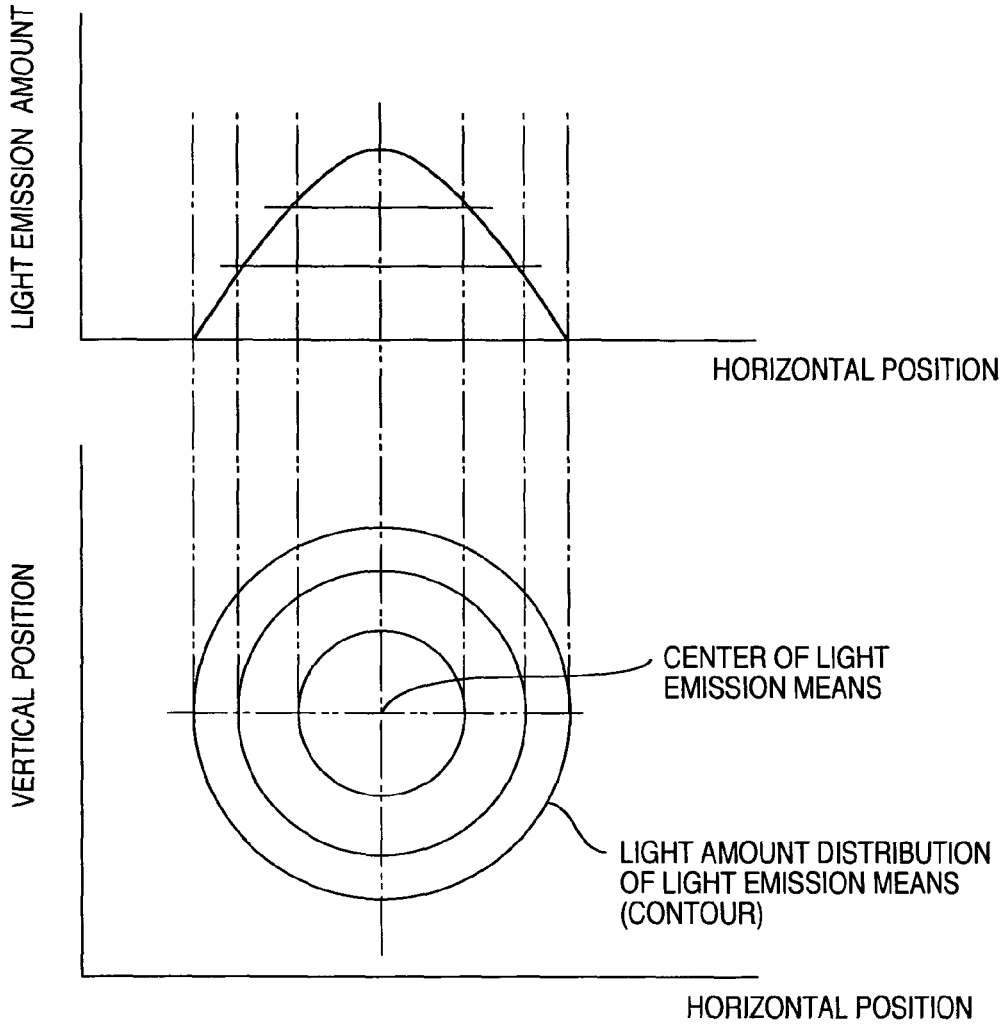
FIG. 9 is a diagram showing the concept of a function approximation of light emission.

FIG. 9 is a diagram showing an example in which the light emission distribution of the light emission unit is illustrated as a two-dimensional (horizontal and vertical) contour. When light emission unit is configured as a backlight, the light emission distribution in the neighboring light emission unit is a leak. The horizontal and vertical positions of the light emission unit are associated with the pixel positions on the liquid crystal panel and the light emission amount in each position is written in the storage unit. This allows the light emission amount of multiple light emission unit associated with pixel positions can be read from the storage unit. If the light emission distributions of the light emission unit included in a combination of multiple light emission unit constituting a backlight are the same, only the representative light emission distribution characteristics are stored in the storage unit. The light emission amount in the pixel position is read from this storage unit and the light emission amounts of the light emission unit are added up to calculate the light emission amount of the backlight in the pixel position.

The height of a contour, that is, the magnitude of a light emission amount, varies according to the magnitude of the driving signal. However, if the shapes of light emission distributions are similar, it is only required to prepare the characteristics of only one light emission distribution. Likewise, the shape of a contour is symmetric horizontally, vertically, or horizontally and vertically, the symmetry property can be utilized to store the relation between the pixel positions and the light emission amount. For example, if the shape of the contour is symmetric horizontally and vertically, the data amount is reduced to ¼ because it is required to store the correspondence relation of only ¼ of the area.

The data described above can be stored in any data structure, for example, can be coded using a description language called XML (extended markup language). Alternatively, the cross section shape of the light emission distribution of the light emission unit or the shape of a contour can be approximated by, and replaced with, a function to reduce the data amount. One of the well-known methods for replacing measured values with an approximation function is a multiple regression. For example, multiple regression analysis is performed for the collected data with a trigonometric function as the base for calculating and storing a coefficient value corresponding to the degree of the trigonometric function. The calculated value can be used as the coefficient value of the trigonometric function to approximate collected data.

For simplicity, assume that the backlight is configured by 16 light emission unit. To supply the driving signal for controlling the light emission amount of each light emission unit when the frame rate is 60 frames/second, 960 (=16 pieces×60 frames/second) data write operations must be executed for one second. To independently control each of the 16 light emission unit, at least two driving signal lines must be connected to each of the light emission unit and, therefore, a total of 32 (16 pieces×2 signal lines) signal lines must be wired.

If write data for one write operation is composed of 16 bits composed of the identification code of the light emission unit and the light emission amount control data, 15360 bits (=960 operations×16 bits) are transferred per second with the data transfer rate being 15.36 k bits/second. The identification code is a signal added to distinguish each light emission unit. Although at most 16 light emission unit must be distinguished in the above example, the number of required bits can be determined according to the manufacturing method and distribution method of the light emission unit. The light emission unit can check a received identification code to determine whether to receive the light emission amount control signal that will be sent following the identification code.

The present invention is characterized in that a serial transmission line, compatible with the data transmission rate described above, is used to transmit the light-emission-amount controlling driving signal to each light emission unit of the backlight. According to the present invention, each light emission unit is only required to have two DC power supply lines and two serial transmission signal lines. If the signal lines share the grounding wire, a total of three signal lines are required to control the light emission amount of each light emission unit. The three signal lines of each light emission unit can be connected in parallel to simplify the wiring. In addition, the power supply line can also transmit the light emission amount control signal, in which case the operation described above can be realized with two signal lines.

Furthermore, the characteristics data of the light emission unit can be transmitted in conjunction with the identification code as described above. For example, an identification code and a content code are supplied from an external source, wherein the former identifies light emission unit and the latter specifies characteristics data to be read, and then the characteristic data is output. Because the light emission unit can be clearly distinguished even if multiple light emission unit share the signal lines for those operations, the wiring of the signal lines can be simplified. Light emission unit can also have a sensor that receives a signal and transmits the received signal to an external device as in the characteristics data output operation described above. This sensor may be an optical sensor for sensing the light emission amount of the light emission unit, a temperature sensor for sensing the operation temperature of the light emission unit, an electric current sensor for sensing an operation current in the light emission unit, or an elapsed time sensor for measuring the operation time of the light emission unit. The sensor signal may be analog or digital.

The apparatus according to the present invention can measure the operation status of each light emission unit with a sensor without complicating the wiring and, therefore, can perform high-precision control operation using the measured result.

The distribution characteristics of the light emission amount can be represented by the signal value of each pixel and, in addition, the distribution characteristics of multiple pixels can be approximated using a function. Any function approximation method can be used in the present invention, including a combination of the trigonometric function and the exponentiation function. A well known multiple regression method can be used for the function approximation of the distributed values obtained through the measurement.

The light emission characteristics, which are the in-screen, two-dimensional distribution values, can be approximated by a two-dimensional function. If there is symmetry in an in-screen area, the number of dimensions can be reduced. For example, if the light emission unit is a square whose light emission distribution is horizontally and vertically symmetric, the light emission distribution of the divided area including the center point can be approximated by a function.

Those function approximations can be calculated as the characteristics of the light emission unit in advance and can be stored in the storage unit in advance.

When each part is manufactured and shipped, characteristics data is stored into the storage unit with which the part can be associated. When a product is shipped after assembling the parts, the characteristics measurement result of the product is stored in the storage unit with which the product can be associated. When the product is in operation, the characteristics measurement result collected by the sensor are fed back and stored in the storage unit.

Fourth Embodiment

The present invention is characterized in that an image signal is transmitted and displayed using two types of signals (normalized signal and normalization coefficient) in normalization representation and in that a new method and means are defined for transmitting an image signal in a new representation format. In particular, because it is important for the transmission of an image signal to be compatible with existing apparatuses, the present invention also proposes a method for smoothly moving from the conventional image transmission method to the image transmission method according to the present invention.

(1) Circuit Configuration

Figure 10A:
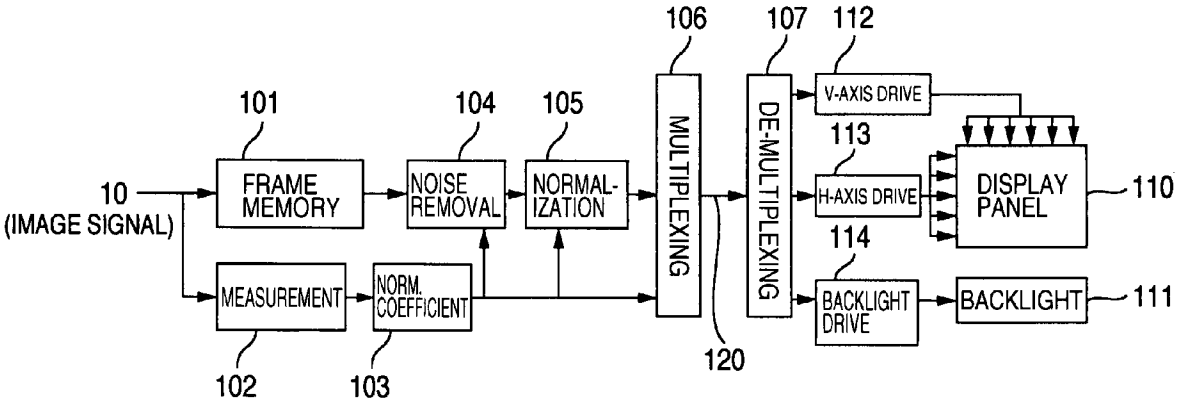
FIGS. 10A and 10B are diagrams showing how an image signal is transmitted.
Figure 10B:
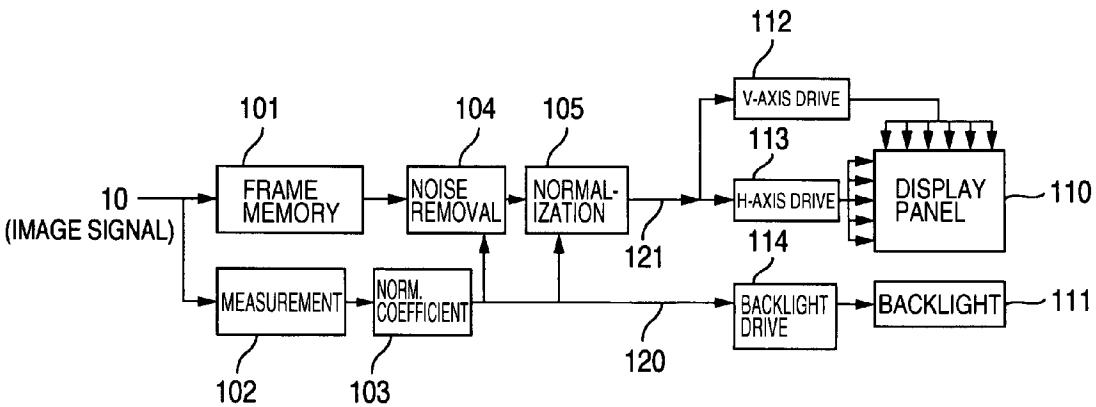

FIG. 10 is a diagram showing an example of the circuit configuration for implementing the present invention. FIG. 10A shows the configuration in which the signal is transmitted serially from a control unit to a display, and FIG. 10B shows the configuration in which the signal is transmitted in parallel from a control unit to a display. First, the following describes the general operation common to both configurations.

A received image signal 10 is written into a frame memory 101 and, at the same time, the signal characteristics are measured by a signal measurement circuit 102. The signal characteristics are, for example, the maximum/minimum values, the histogram, and the color distribution of image data in one screen. To reflect the measurement result of the signal characteristics on a screen onto the same screen, the frame memory 101 operates as a delay circuit for timing the operation. Based on the measurement result, a normalization coefficient setting circuit 103 sets a normalization coefficient. A noise removal circuit 104 removes noise components from the image signal read from the frame memory 101 and, next, a normalization circuit 105 performs normalization processing using the normalization coefficient. In this way, the circuit creates the normalization coefficient of an area composed of multiple pixels and the normalized signal of a pixel normalized by the normalization coefficient.

To serially transmit the normalization coefficient and the normalized signal via a signal line 120, a multiplexing circuit 106 is used to re-sequence the normalization coefficient and the normalized signal into a bit stream according to a predetermined transmission sequence. In addition, a synchronization signal for reproducing the transmission sequence is added, and the multiplexed normalization coefficient and the normalized signal are transmitted using a wiring board, an electrical or optical wiring in the cabinet, and an appropriate transmission method for use with a network and radio waves. The receiving side of the signal line 120 uses a de-multiplexing circuit 107 to demultiplex the received signal into the normalization coefficient and the normalized signal based on the predetermined transmission sequence.

On the other hand, when the normalization coefficient and the normalized signal are transmitted in parallel using signal lines 121 and 122, a long-distance retransmission is usually difficult because of a factor such as a difference (skew) in time among multiple signal lines. However, if the transmission is limited within the cabinet, the parallel transmission eliminates the need for rearrangement of data that would be required for the serial transmission described above, thus making the apparatus configuration simple. The signal line 121 is used to send the normalized signal that is the driving signal for controlling the transmittance of each pixel of the liquid crystal panel, while the signal line 122 is used to send the normalization coefficient that is the driving signal for controlling the light emission brightness of the backlight.

The display, which comprises a display panel 110 and a backlight 111, has drivers for independently driving the both to produce a display output as the combination characteristics of the both. The display panel is configured in such a way that a matrix is driven by a vertical-axis driver 112 and a horizontal-axis driver 113, a backlight driver 114 is driven in synchronization with the driving of the matrix and, as a result of the driving of both the display panel and the backlight, the screen of the display panel is displayed. The backlight 111, used to illuminate the whole or a part of the screen, is controlled by the normalization coefficient. The transmittance of the pixels of the display panel are controlled by the normalized signal. The combination of the light amount of the backlight and the transmittance of the display panel is the display output.

(2) Example of LVDS Circuit Configuration

Figure 11:
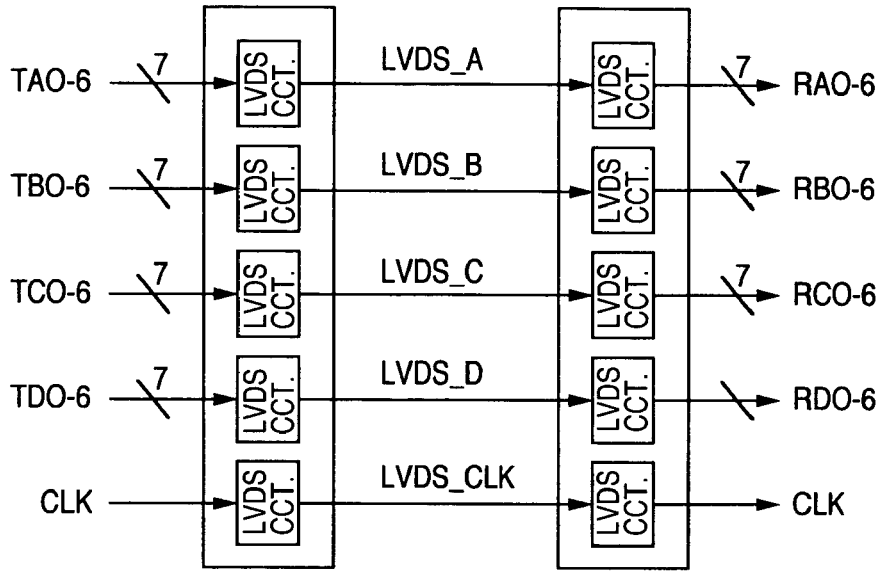
FIG. 11 is a diagram showing an example of the configuration based on the LVDS method.

FIG. 11 shows an example of the actual circuit configuration based on the LVDS method for serial transmission of signals. LVDS, an abbreviation for Low Voltage Differential Signal, is a well-known method for effective high-speed signal transmission, and an LSI that implements this method is commercially available for use in signal transmission and reception. The following describes a circuit configuration that uses this method.

A control unit 1 and a display 2 are connected via one of two signal interface modes: parallel wiring of multiple signal lines by preparing signal lines, one for each bit signal, and serial wiring for transmitting multiple bit signals via a single signal line.

When the control unit and the display device are installed in the same cabinet, the physical distance between them is short. Therefore, the signal line is kept short and, at the same time, many types of signal lines can be wired in parallel. The signal lines can also be wired based on specific specifications.

On the other hand, when the control unit and the display device are installed in separate cabinets, the condition of signal lines for connecting both devices is expected to vary greatly and, therefore, the devices must be configured so that data can be transmitted correctly without being affected by condition variations. One of condition variations is a variation in the transmission time and, if signals are transmitted in parallel, a bit-based skew (delay variation) is generated. Serial transmission using a single signal line is effective for eliminating the effect of this skew.

In general, an LSI for implementing the LVDS method is configured to serially transmit data basically via a seven-bit signal line. This seven-bit signal width is derived from a former standard where six bits (64 gradations) are used for the number of gradations for displaying an image on a liquid crystal display device and one bit is used for the control line. The seven-bit input signal is converted into seven time-series one-bit signals for serial transmission via one pair of signal lines, and the receiving side converts the seven one-bit signals into a seven-bit parallel signal for output.

To transmit RGB signals with a total of 24 bits where each signal is composed of eight bits, it is enough to provide four signal lines with a total of 28 bits where each line is composed of seven bits (28=7×4). In this case, four bit signal lines are left unused. The present invention is characterized in that the normalized signal is transmitted via the seven-bit signal lines and in that the normalization coefficient is transmitted via the four extra bit signal lines.

Assume that image data A to be transmitted is B×C, the normalized signal B is eight bits for each pixel, and the normalization coefficient C is 8 bits for each screen. For RGB three colors, the normalization coefficient is "eight bits×three colors=24 bits" for each screen and the normalized signal is "eight bits×three colors=24 bits" for each pixel. The normalized signal is transmitted in parallel, while the normalization coefficient is serially transmitted via the extra bit signal lines. When the signal interface is closed in the device, the data format and the transmission time of the serially transmitted normalization coefficient may be set freely.

If the receiving side receives the normalization coefficient before the normalized signal to define image data by a combination of the normalization coefficient and the normalized signal, the normalization coefficient can be reflected on the normalized signal immediately after the normalized signal is received. This is achieved by coordinating the screen display time and the data transmission time. That is, the normalization coefficient for the next screen is transmitted during a period of time between the frames or fields of the screen display and, after the transmission of the normalization coefficient, the normalized signal of the screen is transmitted. The receiving side temporarily stores the normalization coefficient of the screen and then combines it with the subsequently received normalized signal for displaying an image. In this way, the normalization coefficient and the normalized signal are synchronized on the same screen. If the normalization coefficient and the normalized signal are received in reverse sequence, it is apparent that the normalized signal must be temporarily stored for one screen in order to synchronize with the normalization coefficient. The comparison between the capacity of memory required for temporarily storing the normalization coefficient and that required for the normalization is as follows. For a VGA (640×480 pixels) screen, the normalization coefficient requires three bytes (24 bits) and the normalized signal requires 24 bits×640×480=921600 bytes for one screen as described above. Because the amount of data required by the normalization coefficient is smaller than that required by the normalized signal, the sequence of data transmission described above is very significant for reducing the amount of required memory.

Although the normalization coefficient is serially transmitted in the example above, multiple extra signal lines can be used if any. For example, if only one bit of extra signal lines is used, the normalization coefficient is transmitted only in the serial transmission format; if two bits are used, the normalization coefficient is transmitted in the serial and parallel mixed format. Any of the transmission formats may be set and, in any format, the receiving side can reconfigure the normalization coefficient. Thus, the data transmission means with the 7-bit parallel/serial conversion function, if available for use, achieves the characteristics of the present invention while maintaining compatibility with the conventional data transmission unit.

The transmission time of the data transmission described above can be determined based on the clock or synchronization signal transmitted via another signal line. It is also possible to prepare a separate control line, which specifies the resetting of the operation procedure or the setting of the characteristic state, for use in an operation combined with the data transmission described above.

The configuration described above, in which existing data transmission apparatuses can be used, decreases the price and the development cost and increases reliability. The normalization coefficient and the normalized signal can be synchronized and transmitted, one screen at a time.

(3) Pixel Sequence

Figure 12:
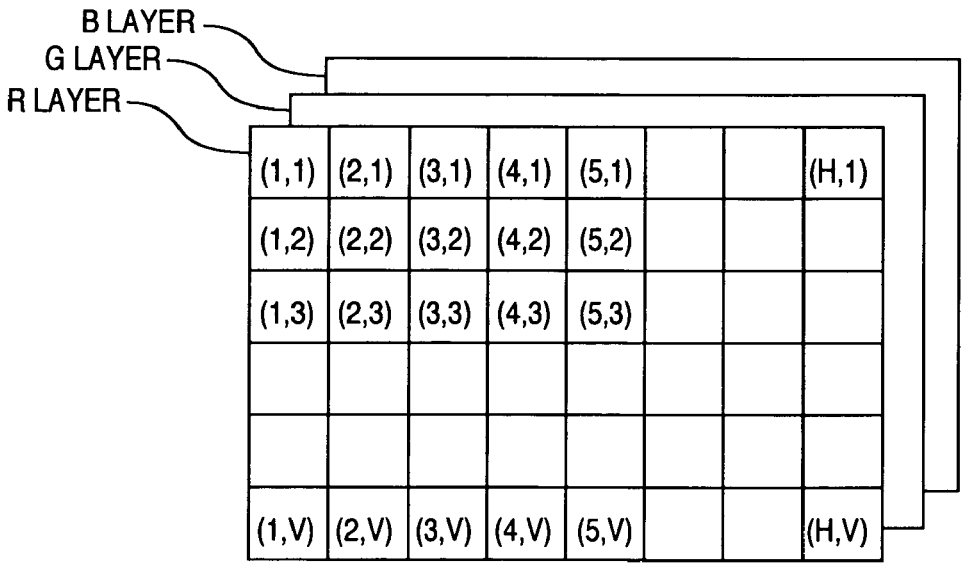
FIG. 12 is a diagram showing an example of the positional relation between the screen and the pixels.

FIG. 12 shows an example of the positional relation between the screen and the pixels. Assume that the signal of each pixel is represented by a combination of three-color RGB signals each composed of eight bits. The pixels are arranged vertically and horizontally to configure the screen. There are many variations of the screen configuration that can be set freely by specifying color signal selections, the pixel size and the number of bits of each color signal, the number of pixels in the screen, and so on.

The screen represented by digital data is called image data. To transmit and accumulate image data, a sequenced data format is necessary. For example, with the top-left corner as the start point and the bottom-right corner and the end point, a so-called bit stream can be configured by sequentially arranging the RGB signals of the pixels on a line basis, each signal sequentially arranged beginning with the high-order bit. The arrangement of the pixels in the screen of a bit stream thus created can be restored based on the sequencing rule.

The display means for displaying image data receives a bit stream created as described above and uses the RGB signals corresponding to a pixel position as the driving signal for displaying the pixel. Although all pixels are displayed basically, the pixels on the fringe of the screen are sometimes cannot be displayed. For example, on a conventional CRT where the pixel positions on the screen are set based on the electron beam deflection, some parts of the fringe are lost due to a fluctuation in the deflection strength or the effect of an external magnetism. Even in such a situation, degradation in the screen quality is not identified in many cases because users tend to keep their eyes in the central part of the screen.

Using the user's tendency described above, the signals of the pixels in the fringe are replaced with the control signals in the present invention. For example, the RGB signal in the pixel position (1, 1) in the figure is replaced with a signal that is not directly used for display but is used as the control signal. Because the use of the control signal is pre-defined both by the transmitting side and the receiving side, a pixel not used by the display unit does not result in image quality degradation. Although the RGB signal of the pixel is lost, the RGB signals in the neighboring pixel (1, 2) or (2, 1) is used for the display. The correlation inherent in neighboring image data keeps the image quality unchanged.

Although the signal of only one pixel position is replaced in the above example, multiple pixel positions may also be replaced. In addition to the replacement of an RGB signal, it is also possible to modulate an existing RGB signal by superimposing the control signal thereon.

In the present invention, the normalization coefficient of image data is set in the control signal prepared in the above configuration. And, the normalized signal is set in the RGB signals in the remaining pixel positions.

The above configuration allows the normalization coefficient and the normalized signal to be transmitted and accumulated in the conventional data format. One of the merits is that the means based on the conventional data format can be used in the generation, transmission, and accumulation of image data. For example, RGB color signals are received and written into a frame memory capable of storing one screen of image data, the signal characteristics of the image data are measured and the normalization coefficient is calculated based on the measurement result, the calculated normalization coefficient is output in the pixel position (1, 1) as the RGB signal, the RGB color signals sequentially read beginning in the pixel position (2, 1) of the frame memory are normalized by the normalization coefficient, and then the obtained normalized signals are output. This makes it possible to output the number of signals equal to the number of pixels of the screen in the same data format as that of the image data. The receiving side apparatus, which has a unit for separating the data into the normalization coefficient and the normalized signal, controls the display driving operation using both the normalization coefficient and the normalized signal. The receiving apparatus writes the signal in the pixel position (1, 1) in the data format temporarily into the storage unit and uses it as the normalization coefficient. The receiving apparatus uses the subsequently received signals as the normalized signal. Alternatively, the received data can be accumulated in the frame memory based on the data format and, by referencing the frame memory using memory address, the normalization coefficient and the normalized signal are separated for use. The display unit, which comprises the backlight and the transmissive liquid crystal panel, uses the received normalization coefficient as the driving signal of the backlight, and the received normalized signal as the driving signal of the liquid crystal panel. Providing two driving unit, that is, the backlight and the transmissive liquid crystal panel, allows a displayed image to have the characteristics of the combination of the two. If the input/output characteristics of the two driving unit are linear, the multiplication of the light emission amount of the backlight and the transmission density of the liquid crystal is the display output.

This enables a wide dynamic range display while using the conventional image data format. In a dark place, the light emission amount of the backlight can be reduced to reduce the required power. In addition, a reduction in the light emission of the backlight in a dark place has an effect of displaying true darkness not dependent on the density setting of the liquid crystal.

The means for transmitting the normalization coefficient and the normalized signal using the signals forming the screen has been described above. In addition to those signals, the signals in the blanking interval, which do not contribute to the formation of the screen, can be used. The signals required for displaying one screen can be transmitted by transmitting the normalization coefficient in the blanking interval and, after that, transmitting the normalized signal as the subsequent image data. The receiving side temporarily accumulates the normalization coefficient in the blanking interval to perform signal processing for reflecting the normalization coefficient on the subsequently received normalized signal. For example, a display apparatus comprising the liquid crystal panel and the LED backlight uses the normalization coefficient described above to drive the backlight, and uses the normalized signal described above to drive the liquid crystal panel, in order to display the screen that is the combination of the backlight and the liquid crystal.

(4) Data Format

The normalization coefficient provided for each screen and the normalized signal normalized by the normalization coefficient are transmitted or accumulated according to a predetermined data format. When they are transmitted, the signal line format, the transmission sequence, and the time at which they are sent must be set based on a rule agree upon both by the transmitting side and the receiving side. This rule can be built in a hierarchical structure or a linguistic syntactical structure to avoid inconsistency.

Figure 13:
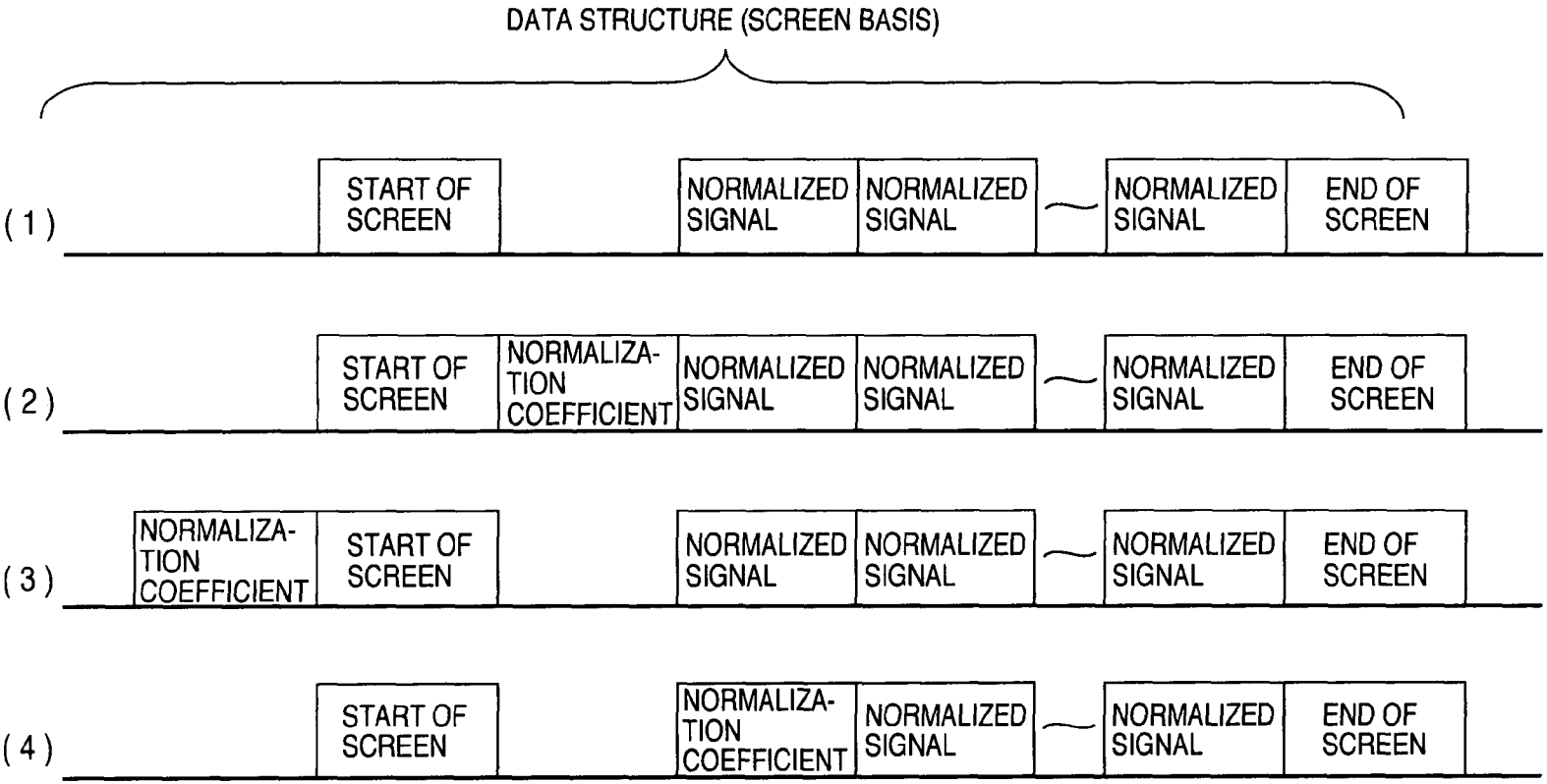
FIG. 13 is a diagram showing the concept of the data format.

FIG. 13 shows an example of the data format used to transmit, via a serial transmission line, the normalization coefficient provided for each screen and the normalized signal normalized by the normalization coefficient. Image data, both still image or moving image, has the synchronization signal added to indicate the start and the end of one screen. The synchronization signal can be defined as a vertical synchronization signal or a horizontal synchronization signal.

The unit of normalization is any of a pixel, a line, a block, a screen, and multiple screens. Identification information indicating the type of the unit of normalization is included in image data to allow the apparatus receiving that information to identify the type. Multiple types of identification information may also be combined. The normalization coefficient based on the identification information and the normalized signal normalized by the normalization coefficient are transmitted sequentially. For the normalized signal to be set in each pixel, the pixel positions constituting the screen and the transmission sequence are defined in advance for transmitting sequential image data. This allows both the transmitting side and the receiving side to transmit data consistently. The normalization coefficient described above may also be built in a signal stored in the vertical blanking interval or the horizontal blanking interval.

Even image data prepared for display sometimes includes data that will not be displayed. For example, a display device that performs an analog scan, such as a CRT, sometimes has image data in the top, bottom, rightmost, and leftmost positions outside the displayable range. Replacing such pixel signals at the end of image data with the normalization coefficient allows a new control signal to be added without changing the data format. Even if used for display, this control signal can be set to an inconspicuous signal, for example, to the signal value of a near-achromatic color.

(5) Signal Timing

Figure 14:
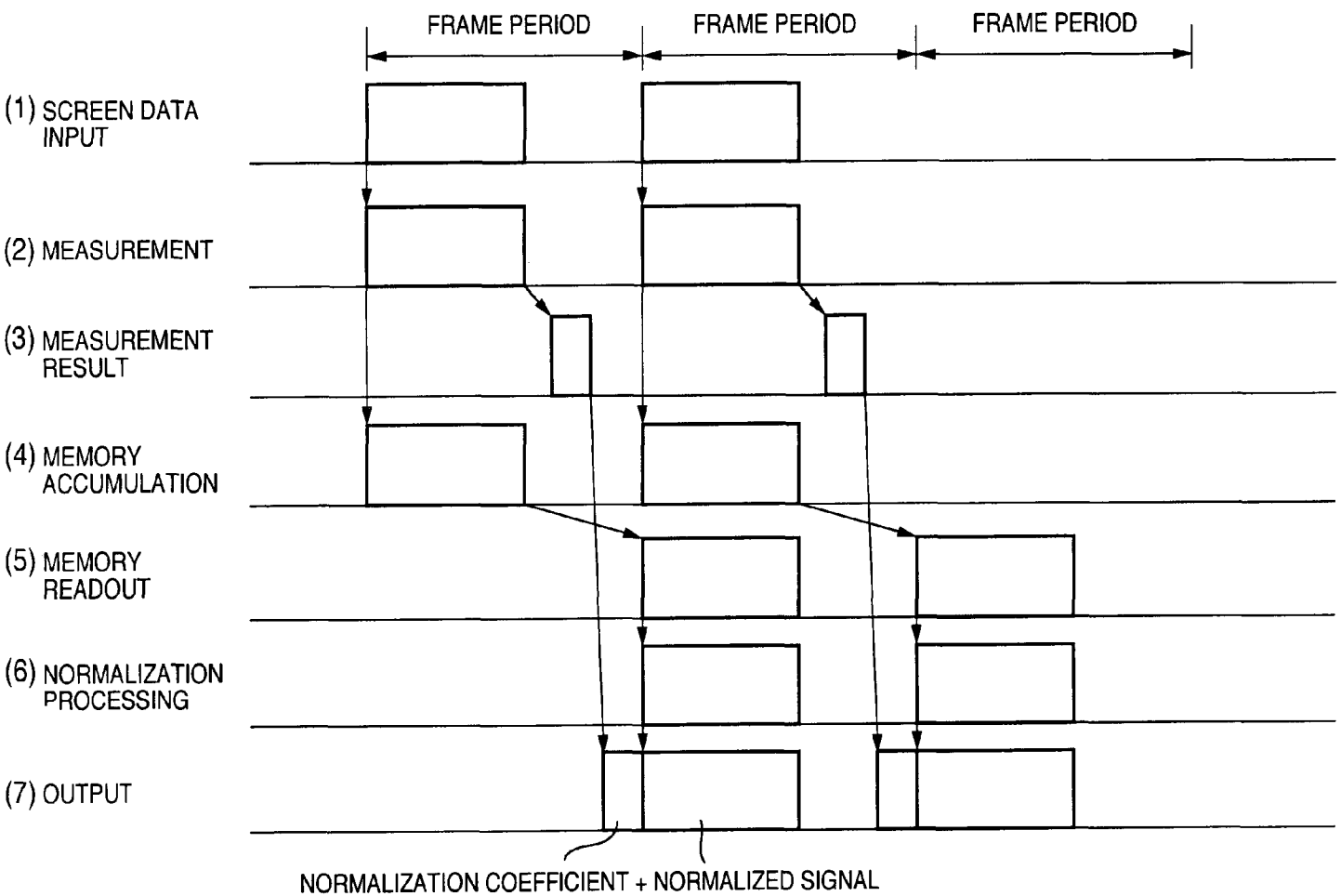
FIG. 14 is a diagram showing the concept of signal timing for displaying a moving image.

FIG. 14 shows a procedure for displaying a moving image.

This figure shows a sequence of time in which one frame of moving image data is received as one screen and the normalization coefficient and the normalized signal are calculated and output from the image data. This sequence is executed as follows. (1) Screen data is received. Any screen data size (number of pixels), frame frequency, data format, and color signal types may be used. (2) The signal of the received image data is measured at the same time the image data is received. Any type of measurement can be made, for example, the maximum/minimum is calculated, a histogram is generated, and so on. (3) The measurement result is obtained after receiving one screen of data. (4) The received image data is accumulated in the memory to perform signal processing for the received image data using the measurement result. (5) The image data accumulated in the memory is read sequentially at an appropriate time and the signal processing is performed using the measurement result. For example, to perform normalization processing, the maximum/minimum value in the screen is measured and then the screen data is normalized. (6) The screen measurement result of the screen and the signal processing result are combined for output. For example, when the normalization processing is performed, the normalization coefficient and the normalized signal are combined.

To allow enough time to be spent on the memory accumulation and the memory read/write operation, the data bus width of the memory should be set wide for efficiency.

When an image data output is serially transmitted, the normalization coefficient must be transmitted before the normalized signal. For example, when the normalization coefficient is set for one screen, the normalization coefficient to be used for the normalized signals of one screen is transmitted first. This transmission sequence enables the receiving side to instantly use the normalized signal, received after the normalization coefficient, for determining the image data.

Conversely, if the normalized signal is output before the normalization coefficient, the receiving side must accumulate one screen of normalized signals before determining the relation with the normalization coefficient. This transmission sequence therefore requires a screen memory and, at the same time, delays the determination of the image data for one frame.

Fifth Embodiment

Calculation of Driving Signal

The following describes a method and means for calculating an image signal in normalization representation. Those method and means are used to transmit and display an image signal using two types of signal (that is, the normalization coefficient and the normalized signal in normalization representation) that are the characteristics of the present invention. Basically, the creation of the two types of signals (normalization coefficient and normalized signal in normalization representation) depends on the characteristics of a display device constituting the display. Therefore, the following describes the light amount distribution characteristics of the backlight of the display device first and, after that, describes the contents of normalization processing that implements the present invention.

(1) Correction of Light Emission Distribution

Figure 15A:
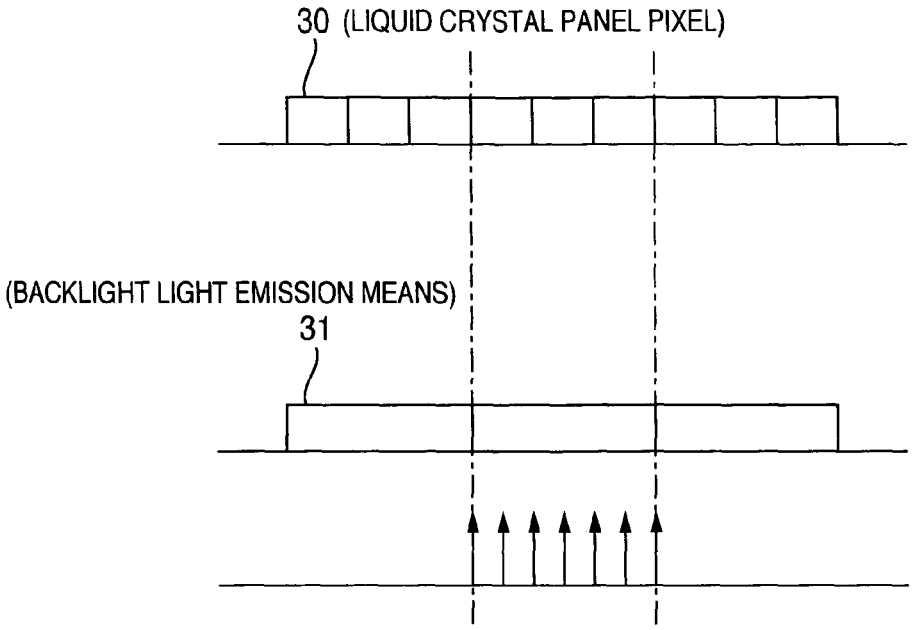
FIGS. 15A and 15B are diagrams showing correction processing (1).
Figure 15B:
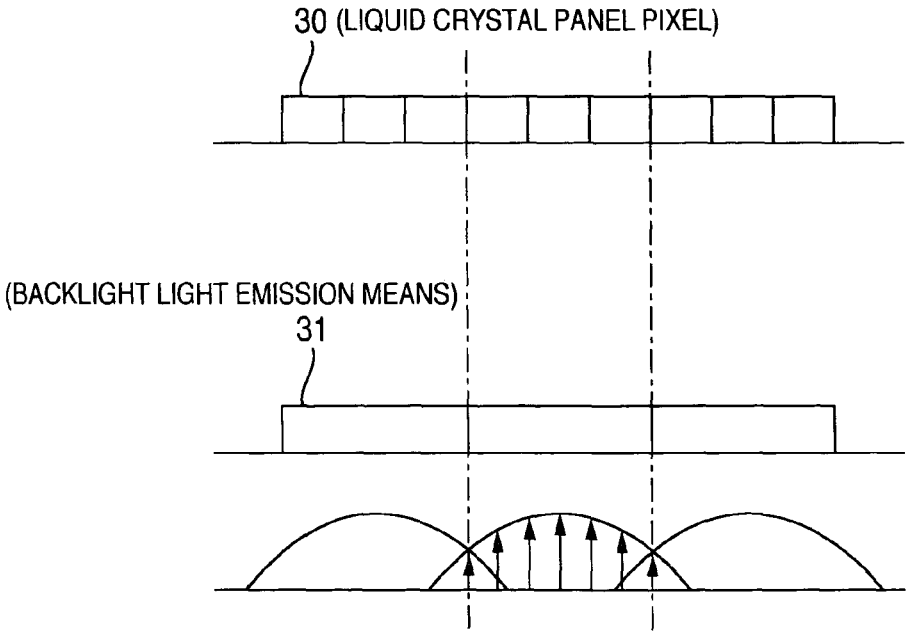

FIG. 15 shows the cross section of the arrangement of pixels 30 of the liquid crystal panel and light emission unit 31 of the backlight as well as the light emission distribution of the light emission unit. FIG. 15A shows a case in which the light emission distribution of the light emission unit 31 is a step function distribution, and the display output of the pixels 30 positioned in an area of the light emission distribution is the result of the multiplication of the light emission distribution size (that is, the height of the step function) by the transmittance of the pixels 30. FIG. 15B shows the distribution characteristics of the light emission unit 31 characterized in that the light amount distribution is high in the center and low in the fringe and in that a light emission distribution leak occurs between the neighboring light emission unit. The display output of a pixel position is affected by the light emission distribution of multiple light emission unit in the pixel position.

The present invention, which allows a leak between neighboring light emission unit caused due to the two-dimensional light-amount distribution characteristics of multiple light emission unit, comprises signal correction unit. Thus, even if there is a positional error between the boundary of the light emission distribution of the light emission unit 31 and the boundary of the pixel 30 of the liquid crystal panel, a change in the light emission amount due to a positional error is suppressed to a relatively small amount and, therefore, the effect on the display output is relatively small. By allowing a leak in this way, exact positional relation precision is not required between the display panel and the light emission unit and so the cost can be reduced. Even if there are the leak characteristics described above, image quality degradation can be prevented by correcting the signal which controls the transmittance of the display panel. The leak characteristics thus allowed in the light emission distribution ease the positional relation condition between the display panel and the light emission unit and, as a result, reduces the cost.

For M pixels arranged one-dimensionally, let A(x) be an image signal at pixel position x, let B(x) be its transmittance, and let C(x) be its backlight light emission amount for the sake of description. Assume that A=B×C is satisfied at pixel position x. This assumption is used to build a simple model of signal relations though not accurate if there are factors called gamma characteristics such as non-linearity and transmittance offset components. Here, assume that the light emission distribution of the light emission unit of the backlight extends across multiple pixel areas and that a leak occurs between the neighboring light emission unit. In this case, to obtain the display output corresponding to image signal A, the minimum light emission amount C is set and, under the light emission amount C, the transmittance B ($0 \leqq B \leqq 1$) is calculated.

First, as a preparation for displaying an image, the light emission characteristics of multiple light emission unit of the backlight are measured. The measurement result is collected as a relation between a combination of driving signals of the light emission unit and the light emission amount of the light emission unit in a pixel position on the screen. This can be collected by measuring the surface of the backlight using a luminance meter or a spectroradiometer. Note that, because the setting of the driving signal of the light emission unit for giving the light emission amount C at pixel position X is a combination of light emission distributions of multiple light emission unit, there are multiple combinations of driving signals. In the present invention, one of multiple combinations of driving signals is selected according to the following procedure.

(1) Collect the measurement values of light amount distribution characteristics of the light emission unit for initializing the procedure.

(2) Start the repeating loop ((2)-(9)) in which the settings of the magnitude A of the input image signal and the position X are varied.

(3) Start the repeating loop ((3)-(7)) in which the combination of driving signals of the light emission unit is varied.

(4) Calculate the light emission amount C in pixel position x corresponding to the driving signal of the light emission unit.

(5) Calculate the consumption energy of all light emission unit if the condition A<C is satisfied.

(6) Temporarily save the setting value of the driving signal if the minimum value of consumption energy is updated; otherwise, go to the next step.

(7) Go back to (3) of the loop (driving signal).

(8) Accumulate the temporarily stored driving signal setting value in the table.

(9) Go back to (2) of the loop (magnitude and position).

In case where multiple light emission unit of the backlight have exactly the same light emission characteristics, the measurement result of one representative light emission unit can be used as the light emission characteristics of the multiple light emission means. In this case, the light emission amount of a pixel position can be calculated by reading multiple measurement results of shifted positions based on the light emission distribution characteristics of the representative light emission unit described above and then by adding the light emission amounts of the multiple light emission unit. Alternatively, if the light emission distribution of the light emission unit can be approximated by a function, the approximated distribution characteristics can be used as the light emission distribution characteristics of the light emission unit in the same manner as the light emission characteristics of the representative light emission unit described above. In either case, the light emission amount C in pixel position x corresponding to the combination of all driving signals of the light emission unit can be calculated.

Next, the following describes a procedure for calculating the driving signal of the light emission unit required for displaying an actually received image signal A. If the light emission unit is provided for each pixel, it is only required to calculate the driving signal of the light emission unit satisfying the relation A<C for each pixel considering the relation A=B×C and $0 \leqq B \leqq 1$. However, in this embodiment, because the light emission distribution of the light emission unit extends across multiple pixel areas, the condition A<C must be satisfied in multiple pixel areas. In addition, because the image signal is generally received in the scan sequence, the driving signal of the light emission unit satisfying the above condition should preferably be calculated in the scan sequence of the image signal. In the present invention, the following procedure is executed while scanning the image signal.

(1) Sequentially receive the image signal A in the pixel area.

(2) Based on the position and the magnitude of the received image signal A, find a combination of driving signals of the light emission unit satisfying the minimum energy condition from the created correspondence table.

(3) Replace the value of the driving signal if the driving signal of the light emission unit newly obtained for the pixel is larger than the driving signal that is already set for the received pixel.

(4) Go to the next image signal A and repeat the procedure beginning in step (1).

(5) Accumulate the driving signal of the light emission unit into the memory.

The driving signal of the light emission unit required for displaying the image signal A is calculated as described above, and the result is accumulated in the memory. Next, the transmittance B ($0 \leqq B \leqq 1$) for each pixel on the liquid crystal panel required for displaying the image signal A is calculated. To do so, the image signal A is received again in the scan sequence and, at the same time, the light emission amount C of the light emission unit corresponding to the position of the received image signal A is obtained from the driving signals accumulated in the memory. If the relation A=B×C is satisfied, the transmittance B of each pixel can be calculated by B=A/C because A and C are already determined. Alternatively, if the above relation expression is not satisfied due to the factors such as the gamma characteristics, it is also possible to calculate B from A and C by measuring the relation of a combination of A, B, and C in advance and storing the result in the correspondence table. If the combination characteristics of those signals can be approximated by a function, a calculation procedure using function approximation can also be used to calculate the signal B without using the correspondence table. Of course, some method can be used to reduce the size of the correspondence table.

As described above, the general procedure is summarized into the following three steps:

(1) Calculate the combination of driving signals of the light emission unit.

(2) Calculate the driving signal of the light emission unit for displaying the image signal.

(3) Calculate the transmittance for displaying the image signal. Step (1) is a preparatory step, and steps (2) and (3) are real-time signal processing. The image signal in the screen is scanned twice in steps (2) and (3) to calculate the driving signal of the backlight and that of the liquid crystal panel. That is, the driving signal of the light emission unit is calculated in the first scan, and the transmittance of each pixel is calculated in the second scan. All received image signals must be retained in the first scan but they are unnecessary after the signal processing of the second scan. Therefore, if the image signal is input/output in the same scan sequence, one screen of memory is provided and the above procedure is executed by executing the first scan operation during the reception of the image signal and then writing the image signal into the memory and by reading the image signal from the memory during the output of the image signal and then executing the second scan operation.

Although the driving signal of the light emission unit is accumulated in the memory, the data mount is smaller than that for the image signal because one driving signal is provided for each pixel area.

Of course, the procedure and the means described above are applicable also to the display output of a color image. The driving signal is calculated for each color signal of the light emission unit and, based on the result, the transmittance is calculated for each pixel.

As described above, the present invention enables the calculation of the driving signal of the light emission unit for displaying the image signal using the processing procedure for minimizing the energy and for executing simple but high-speed processing.

(2) Calculation of Driving Signal

Figure 16:
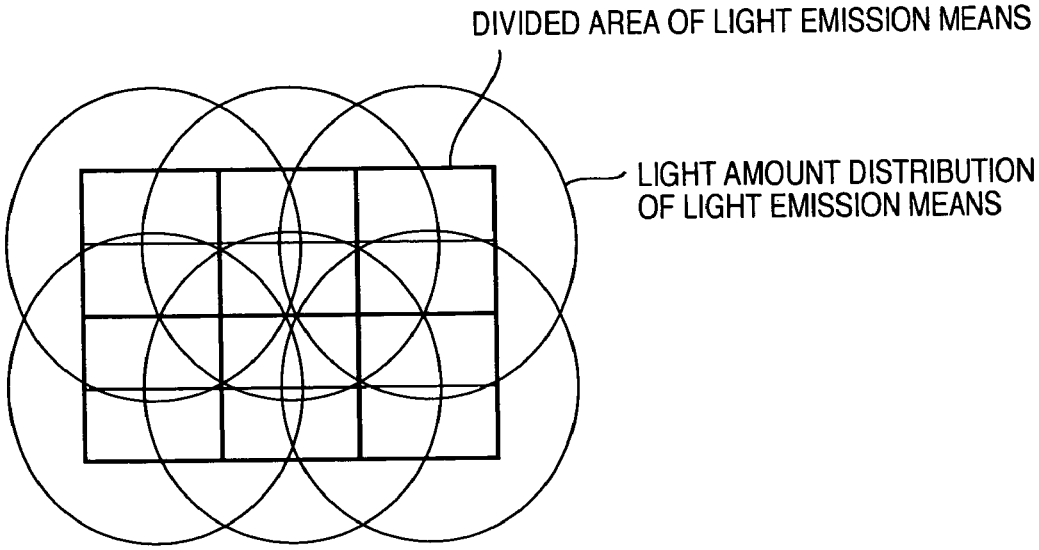
FIG. 16 is a diagram showing correction processing (2).

FIG. 16 shows the two-dimensional divided areas of the light emission unit of the backlight and the light emission distributions of those light emission unit as well as the two-dimensional leak characteristics indicating that the light emission distributions of the neighboring light emission unit overlap each other. The divided area of each light emission unit corresponds to two or more pixel areas of the liquid crystal panel, and the light emission amount of the light emission unit and the transmittance of each pixel are combined to give a display output. A two-dimensional image composed of an array of pixels can be treated as a combination of multiple one-dimensional pixel arrangements based on the scan sequence. The shape of a divided area, dependent on the arrangement of the light emission unit of the backlight, is one of (1) a stripe, (2) a square block, and (3) a random block and, in addition, the two-dimensional leak characteristics must be taken into consideration.

When the two-dimensional characteristics are taken into consideration, the procedure for calculating the driving signal is similar to that for calculating the one-dimensional characteristics described above. First, as a preparatory step, the procedure for calculating the driving signal of the light emission unit of the backlight for a pixel position x is prepared considering a condition for minimizing the energy.

Next, the following two-pass procedure is executed according to a received image signal.

(1) Calculate the driving signal of multiple light emission unit, corresponding to the position and the magnitude of the received signal A, for the whole screen to calculate the driving signal of the light emission unit required for the whole screen.

(2) Calculate the transmittance B of the pixel, which satisfies $A=B\times C$, for the whole screen from the light emission amount C in the position of the received image signal A.

To execute the procedure described above, a memory for accumulating the received image signal and a memory for accumulating the driving signal calculated in procedure (1) are provided. The transmittance calculated in procedure (2), that is, the driving signal for the liquid crystal panel, may be accumulated in the memory until one screen of data is collected or may be sequentially output according to the calculation sequence.

The light emission amount of the light emission unit and the transmittance of a pixel, calculated as described above, are, in other words, the normalization coefficient and the normalized signal, respectively. To allow the both to be used at the same time, they are shaped on a frame basis before being output for display on the display device.

The above procedure is applicable also when the backlight is configured by RGB (red, blue, green) colors. Even when the number of received image signal types is three, the driving signal of the light emission unit and the transmittance of a pixel are set for each color image signal for implementing the method described above. Even when the backlight is composed of more than three colors, for example, RGBW, the same procedure can also be used.

Circuit Configuration

Figure 17A:
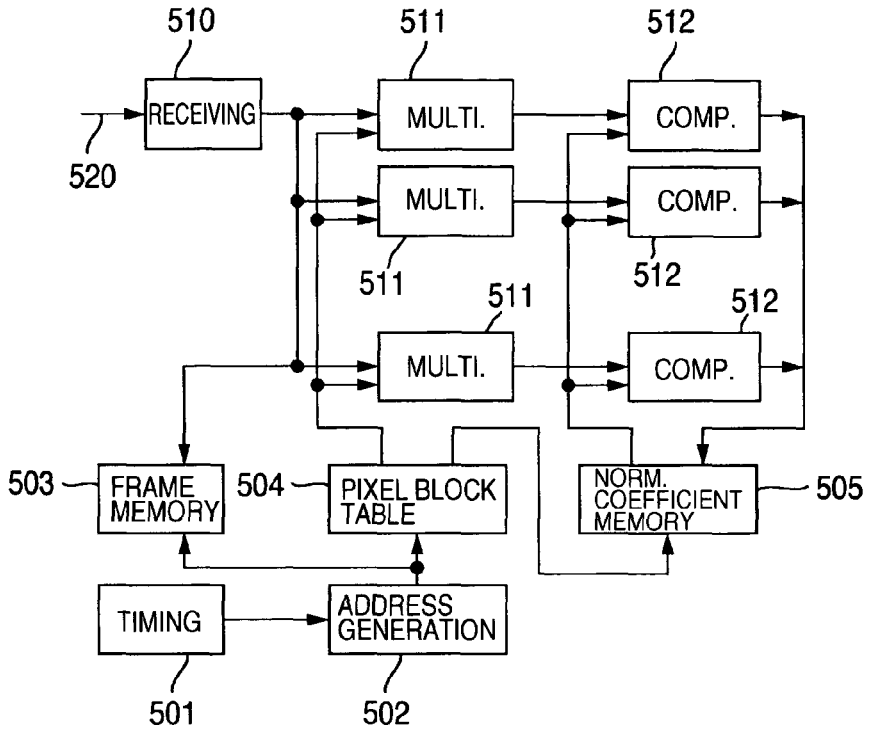
FIGS. 17A and 17B are diagrams showing the configuration of a circuit for calculating the normalization coefficient of a pixel.

FIG. 17A shows the configuration of a circuit for calculating the normalization coefficient of a pixel from the light emission amount of a pixel block required for giving the display output of each pixel of a received image signal 520 for which a sequential scan is performed for one screen. The pixel block refers to a collection of pixels on the liquid crystal panel corresponding to a divided area of the light emission unit of the backlight. Therefore, the pixel block, which depends on the arrangement and the shape of the light emission unit, is determined when the product specification is prepared or when the product is shipped from the factory.

When the normalization coefficient and the normalized signal are converted to actual driving signals, the normalization coefficient is the driving signal of the light emission unit constituting the backlight and the normalized signal is the transmittance of a pixel on the liquid crystal panel.

The general operation is controlled by a clock generated by a timing circuit 501. In the figure, the clock is supplied to an address generation circuit 502.

In synchronization with the received image signal 520, the address generation circuit 502 generates an address signal, which indicates the positional relation between the screen and a pixel, and supplies the generated address signal to a frame memory 503 and a pixel block table 504. A receiving circuit 510 captures the received image signal 520 and outputs the captured signal to a multiplication circuit 511 and the frame memory 503 for signal processing. The pixel block table 504 accumulates therein, in advance, the identification number of a pixel block to which a received pixel belongs and a contribution ratio between the light emission distribution of the pixel block to which the received pixel belongs and the light emission distribution of the neighboring pixel blocks in the pixel position. Not only the address signal for reading the pixel block table 504 is supplied from the address generation circuit 502 described above but also the magnitude of the received image signal at the address can be used as the address signal.

For each pixel block, the multiplication circuit 511 multiples the received image signal 520 by the contribution ratio of the light emission distribution of each pixel block in the pixel position that is read from the pixel block table 504 to produce the control signal of each block required for giving an output corresponding to the received image signal 520.

This control signal of each block, which will be used to normalize the received image signal 520 in the procedure described later, is called a normalization coefficient. A comparison circuit 512 compares the normalization coefficient output from the multiplication circuit 511 with the normalization coefficient stored in advance in a normalization coefficient memory 505 and selects the larger of the two. After that, the selected normalization coefficient is written in the normalization coefficient memory 505 again. This operation is performed for one screen to store the normalization coefficients of the pixel blocks into the normalization coefficient memory 505.

The light emission unit constituting the backlight is expected to have a light emission distribution that differs according to the device type. To flexibly meet the requirements of various device types, the light-emission distribution contribution ratios are stored in the pixel block table 504 based on the light emission distribution characteristics measured in advance. The contents of the table, if common to the pixel blocks, can be shared. When the light emission distribution can be approximated using a function, the contents of this table can be replaced with a function generation device to reduce the table size.

Figure 17B:
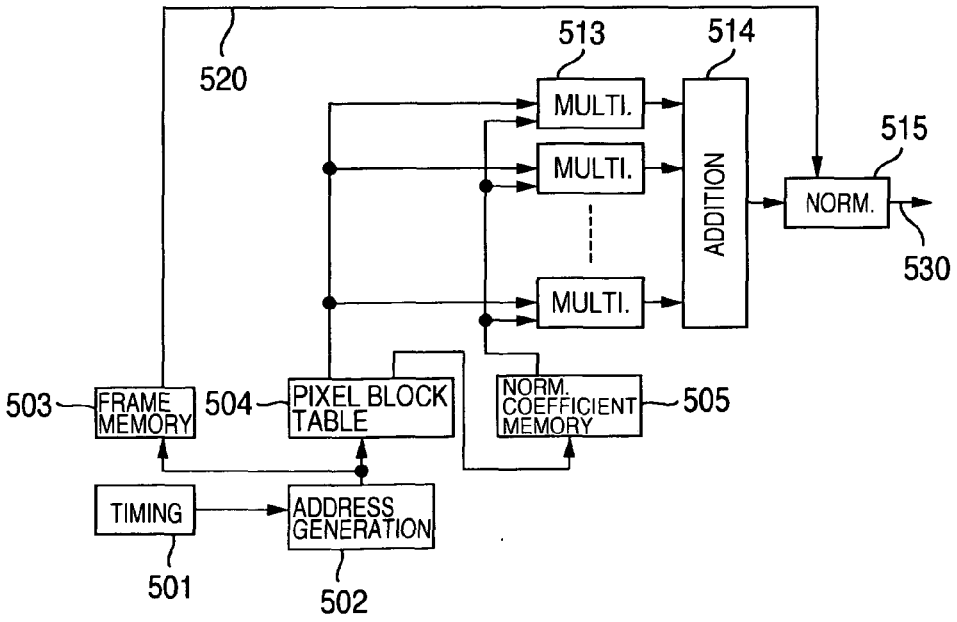

Next, with reference to FIG. 17B, the following describes the configuration of a circuit for calculating the normalized signal of a pixel using the signals stored in the normalization coefficient memory 505 and the frame memory 503.

The general operation is controlled by a clock generated by a timing circuit 501. In the figure, the clock is supplied to an address generation circuit 502.

Not only the address signal for reading the pixel block table 504 is supplied from the address generation circuit 502 described above but also the magnitude of the received image signal at the address can be used as the address signal. A multiplication circuit 513 multiples the contribution ratio of the light emission distribution of each pixel block in the pixel position that is read from the pixel block table 504 by the light emission amount of each pixel block read from the normalization coefficient memory 505, and an addition circuit 514 adds up the multiplication results to calculate the light emission amount, that is, the normalization coefficient, in the pixel position. After that, the received image signal accumulated in the frame memory 503 is divided by the normalization coefficient to calculate a normalized signal. This normalized signal is a value corresponding to the transmittance used to control the light emission amount in the pixel position. Those signals are summarized as A=F (B, C) where A is the received image signal, B is the normalized signal in the pixel position, and C is the normalization coefficient in the pixel position. In this embodiment, B is a signal for controlling the transmittance on a pixel basis on the display panel, C is the light emission amount of the light emission unit in the pixel position, and F is the combination characteristics of B and C, which represents, for example, the multiplication A=B×C.

In addition, a circuit unit for setting the gamma characteristics can be combined as necessary.

(3) Noise Removal

An image signal sometimes includes unintended noises. To remove noises, a pixel with a low correlation between neighboring pixels is removed, a pixel in the top or bottom of the signal amplitude is removed, a pixel for low-frequency color pixel is removed, or unwanted frequency components are filtered out. The effect of low-frequency, meaningless noises is removed so that the image quality of the whole image display output is increased.

(a) Correlation between Pixels

A noise generated due to a random cause generates an isolated pixel having the signal value of the noise. Because a regular signal indicates the structural characteristics of an image, such a pixel is essentially different from other pixels in the distribution. In such a case, except an isolated pixel whose signal level greatly differs from those of the neighboring pixels, the maximum and the minimum of the signal are measured to perform normalization for reducing the effect of the noise. In removing noise signals, the constant E is used as a noise removal determination condition.

(b) Histogram

In a histogram where signal values and their occurrence frequencies are related, a pixel with the maximum value and a pixel with the minimum value are sometimes out of the correct signal amplitude due to a cause not generated for a regular signal. Therefore, the pixels near the top and the bottom of the histogram are removed and the maximum and the minimum of the signal are measured to perform normalization for reducing the effect of the noises. In removing noise signals, the constant E is used as a noise removal determination condition.

(c) Chromaticity Diagram

The chromaticity diagram, one of the methods for showing the color distribution, indicates the characteristics of color signal combination. In addition, the chromaticity diagram can indicate a color solid that is the combination of chromaticity and brightness. A color signal is positioned in the internal coordinate of the chromaticity distribution and the color solid. Meanwhile, a color signal that is outside or in the margin of the chromaticity distribution or the color solid, that is, a high-saturation pixel, a high-brightness pixel, or a low-brightness pixel, is supposed to be affected by a noise. Thus, the maximum and the minimum of the signals except those of the pixels in the margin of the chromaticity diagram or the color solid are measured and normalization is performed to reduce the effect of noises. In removing noise signals, the constant E is used as a noise removal determination condition.

(d) Frequency Characteristics

A noise usually with isolated characteristics in the signal amplitude in the time axis direction has high frequency components. In some other cases, a signal is sometimes superimposed by a noise with a specific frequency distribution. A noise, which can be characterized by frequency characteristics, can be removed by removing a frequency component with those characteristics. For example, because an image compression technology such as JPEG or MPEG uses a conversion procedure, called Discrete Cosine Transform (DCT), for converting image data to frequency components, the DCT conversion result can also be used to remove noises.

Figure 18:
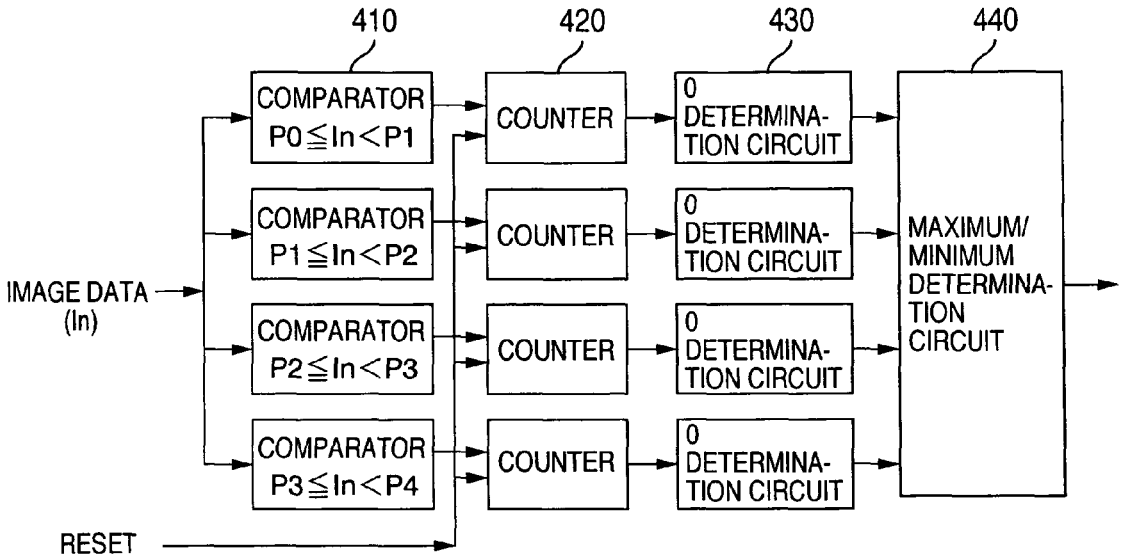
FIG. 18 is a diagram showing an example of the configuration of histogram measurement means available for noise removal.

For example, a histogram described above in (b), which can be used as an index representing the signal characteristics of the whole image data, can also be transmitted and accumulated directly with the image signal as information added to the image signal without converting the data to parameters such as the maximum and the minimum values. FIG. 18 shows an example of the configuration of histogram measurement unit available for this purpose.

The maximum value and the minimum value are calculated from a sequence of image data (In) delimited by reset signals. The histogram measurement unit comprises multiple sets each composed of a comparator 410, which compares the received image data In with a comparison determination value P, and a counter 420, which is incremented according to the comparison result. The counters are incremented when pixels are received, and are reset when a unit of measurement (screen, line, etc.) is processed, to produce a histogram for each unit of measurement. If the circuit becomes too complicated because of the counters provided one for each signal value, the comparison value P used by the comparator 410 can be adjusted to set a range of signal values, for example, one counter for each eight or 16 signal values, to reduce the number of counters. To convert the histogram created by this measurement to the characteristics values such as the maximum value and the minimum value, a 0 determination circuit 430 is used to determine whether the count value of the counter 420 is 0 or larger. The determination result, 0 and 1, of the four counters shown in the figure is represented as a 4-bit pattern. A maximum/minimum determination circuit 440 has the four-bit pattern determination table to calculate the maximum value and the minimum value. If the determination circuit 430 uses a value larger than 0 for determination, a low count value generated by a noise can be removed.

Alternatively, image data can be transmitted and accumulated as temporary information with no modification for later use. For example, image data is temporarily stored in a frame memory 430 and the histogram or the characteristics amount such as the maximum value and the minimum value obtained as a measurement result and the image data to be measured are converted to a predetermined data format by a multiplexing circuit 440 before being output.

A memory with address lines and data lines is prepared as the measurement unit, and the signal value is used as a memory address to read data from the memory. To produce a histogram for each unit of measurement (screen, line, etc.), one is added to the content that is read, the addition result is written back in the same memory address, and the memory is cleared when the unit of measurement (screen, line, etc.) is processed. Data is read from, modified in, or written into the memory in an operation mode, called a memory read modified write mode, to increase the operation speed.

The histogram created by the means described above can be used to convert image data to characteristics amounts, such as the maximum value and the minimum value, and to produce a pattern of the signal values and their occurrences.

The means described above measures not only RGB three colors but also the brightness and the color-difference signal such as YUV. A histogram for the color distribution can also be measured by converting the signal to the xy (lower-case xy) color system indicating the chromaticity or the Lab color system. In either case, the measurement can be implemented by adding the color signal conversion means to the measurement unit described above.

(4) LED Backlight

The following describes the configuration of a liquid crystal display comprising multiple components, that is, a backlight and liquid crystal elements, in which the normalization coefficient is used to control the backlight and the normalized signal to control the transmittance of the liquid crystal elements. In particular, the following describes the configuration and the effect of a display that uses LEDs (Light Emitting Diode) for independently displaying RGB three colors as the backlight.

The liquid crystal display device described below has a signal interface that receives the normalization coefficient and the normalized signal. A general-purpose method, the so-called DVI (Digital Video Interface), is used as the physical interface specifications. Although not limited to this method, the DVI is employed as an example of the configuration for reducing the cost because the LSI and the cables constituting the interface unit need not be newly developed. The time at which the DVI signal is transmitted is determined for an existing display but, of course, the normalization coefficient and the normalized signal for implementing the present invention are not defined. The present invention provides higher-level functions while maintaining compatibility with such a conventional interface. The implementation of the present invention does not always require compatibility with the conventional devices, but a unique interface may also be used.

Figure 19:
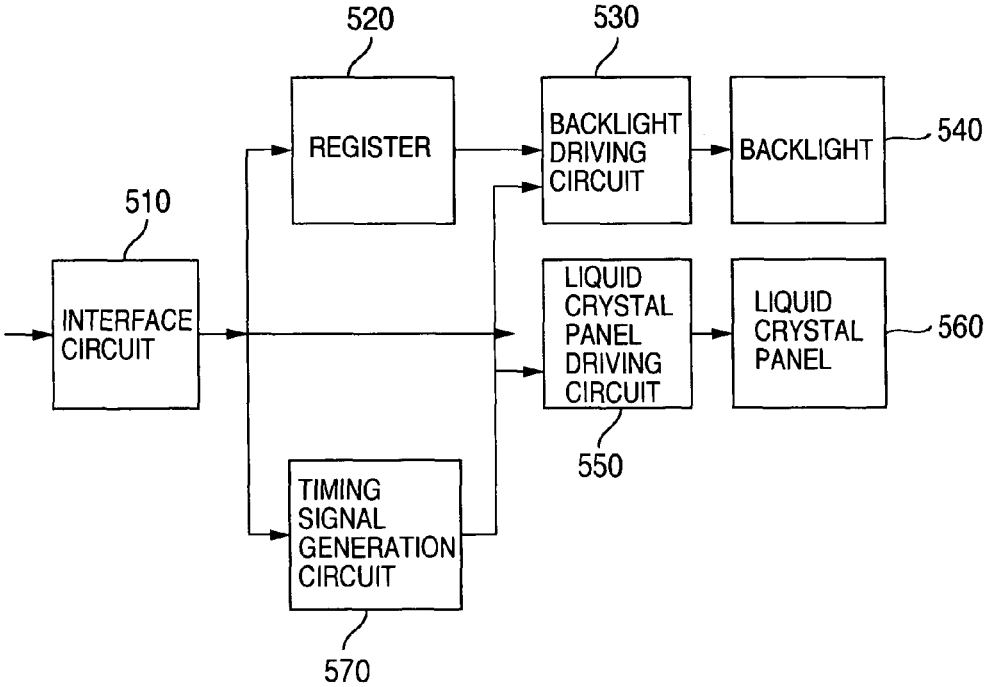
FIG. 19 is a diagram showing the configuration of a LED backlight.

The liquid crystal display device shown in FIG. 19, designed for connection with an external unit with a signal processing function, does not require signal processing in the liquid crystal display device.

The vertical blanking interval and the horizontal blanking interval, originally defined based on the CRT operation principle, are not necessary for a liquid crystal display but are required for maintaining compatibility with the interface specifications. Therefore, as long as the liquid crystal display device according to the present invention is used as a display, those intervals can be used in any way. Therefore, the present invention uses the vertical blanking interval to transmit the normalization coefficient on a screen basis, and uses the effective blanking interval following the vertical blanking interval to transmit the normalized signal of the same screen on a pixel basis. The liquid crystal display on the receiving side comprises an interface circuit 510 for extracting the normalization coefficient, the normalized signal, and the synchronization signal. The liquid crystal display further comprises a register 520 in which the normalization coefficient is temporarily stored. The normalization coefficient accumulated in the register, which is used as the input signal of a driving circuit 530 of the RGB (red, blue, green) LED (Light Emitting Diode) of the backlight, drives a backlight 540. The subsequently received normalized signal, which is used as the input signal of a driving circuit 550 of the liquid crystal elements arranged in the liquid crystal panel, drives a liquid crystal panel 560. Because the liquid crystal elements have delay characteristics between the moment the liquid crystal elements are driven to the moment actual responses are returned, the driving time of the LED driving circuit can be configured considering the delay characteristics of the liquid crystal elements. The operation procedure for the above-described means is instructed by a timing signal generation circuit 570 using the synchronization signals, such as the start and end of the screen display reproduced from the DVI signal and the pixel clock. In case the liquid crystal display has a frame memory and a clock signal generation circuit for display an output, the operation time of the above-described means can be set to any time within the liquid crystal display.

The LEDs of the backlight have a relatively narrow light emission spectrum and, as compared with the conventional CRT display, the LEDs tend to have higher display color saturation. In addition, the light emission spectrum distribution varies delicately with the type of LED. If the difference in color reproduction, which depends on the light emission spectrum distribution, must be corrected through signal processing, the normalization coefficient and the normalized signal for the result of correction processing are required. Because the configuration of the device for receiving the normalization coefficient and the normalized signal is described here, the device receives the result of the correction processing performed in an external device. To allow an external device to perform the correction processing, the correction information dependent on the display must be transmitted to the external device that performs the correction processing. For example, the information on the LED spectrum distribution described above corresponds to the correction information. Although the operator can manually set this correction information, the correction information can also be set through a negotiation via the signal lines. This negotiation is performed before transmitting the normalization coefficient and the normalized signal, for example, when the device power is turned on or when the device configuration is newly built.

(5) Example of Signal Processing Circuit Configuration

When the light emission unit of a pixel block does not affect the other pixel blocks, the normalization coefficient and the normalized signal can be calculated from the signal characteristics of the pixel block.

Figure 20:
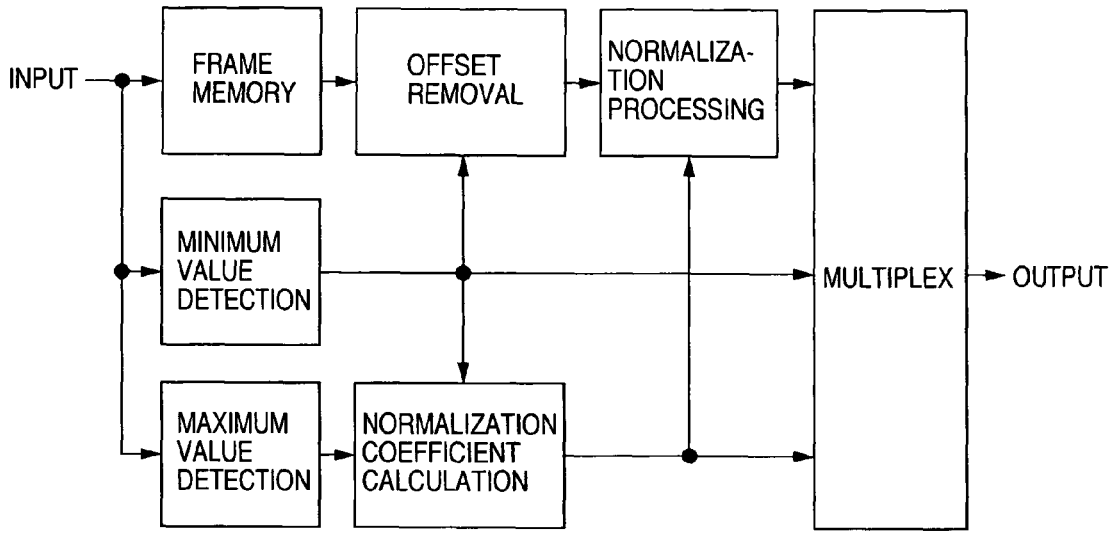
FIG. 20 is a diagram showing the configuration of a normalization processing circuit.

FIG. 20 shows the device configuration in which image data is received, normalization processing is performed based on the maximum value and the minimum value, and the processing result is multiplexed into a bit stream for output.

A minimum value detection circuit 330 and a maximum value detection circuit 340 receive image data and sequentially compare the signal values of pixels to detect the maximum value and the minimum value. When the detection circuits are reset by the screen synchronization signal, the maximum value and the minimum values can be detected for each screen; when those circuits are reset for each block or line of the screen, the block or the line can be set as the unit of maximum and minimum value detection. Image data is accumulated into, and read from, a frame memory 320, and any delay time can be set within the memory capacity restriction. The maximum value and the minimum value detected in this way can be used in the signal processing of image data on the screen for which those value are detected.

The maximum value Max, the minimum value Min, and the values of B, C, and D satisfying the normalization processing result A=B×C+D are calculated. To do so, with D as the output Min of the minimum value detection circuit, a gain calculation circuit 350 is used to calculate B=(Max−D)/255, an offset removal circuit 360 is used to calculate (A−D), and a normalization processing circuit 370 is used to calculate C=(A−D)/B. After that, B, C, and D are multiplexed into a single bit stream according to the predetermined data format for output via a serial transmission line.

Although, for a circuit built in the device, the signal lines can be used directly based on the clock signal or the synchronization signal for synchronizing the signal lines B, C, and D without using the multiplexing circuit or the serial transmission line described above, a synchronization problem may occur between multiple types of signals that are transmitted speedily. One of the merits of the present invention is that this problem is solved by serial transmission.

To perform signal processing using the measurement result of the signal characteristics of image data, a procedure is required for storing a received image signal temporarily in the memory and for reading the image signal from the memory according to the sequence of signal processing. To measure the signal characteristics for each screen, the reception of the image signal and the output of the signal processing result can be synchronized on a screen basis by accumulating and reading the image data into and from the memory, one screen at a time. If image signal is received sequentially on a line basis and if the normalized signal of the signal processing result is output sequentially on a line basis, the image signal can be written and read in the same pixel sequence with one screen of delay between the write operation and the read operation. Alternatively, if the same memory address can be shared and the memory operation called a read modified write operation can be used, the pixel signal is read from the memory using a sequentially generated memory addresses for use in the normalization processing and then a newly received pixel signal is written in the memory address. This memory read operation and the memory write operation can be completed as a sequence of operations using the same memory address. Such a read modified write operation can be executed faster than an operation in which the image data is read from and written into the memory separately.

On the screen divided horizontally into eight and vertically into six (number of block divisions N=48), the maximum value of the horizontally arranged eight blocks can be detected each time one-sixth of the screen in the vertical direction is received and so the normalization processing can be started for the horizontally arranged eight blocks. Thus, only the one-sixth of the screen in the vertical direction is required to be stored in the memory.

Using the maximum value of each of the blocks of the divided screen (divided horizontally into eight and vertically into six), the measurement result can be converted to that corresponding to a different number of block divisions (N). For example, to convert the measurement result to the maximum value measurement result of a block created by dividing the screen horizontally into one and vertically into six, the maximum value measurement result of horizontally arranged eight blocks can be used to measure the maximum value again. To convert the measurement result to the maximum value measurement result of the whole screen, the maximum values of 48 blocks (divided horizontally into eight and vertically into six) can be used to measure the maximum value again to produce the maximum value common to all blocks, that is, the maximum value of the whole screen.

Using this property, the circuit is configured by setting the number of blocks corresponding to the maximum number of divisions for measuring the signal characteristics and, after that, the measurement result is converted according to the number of block divisions N actually used. This method eliminates the need for preparing measurement circuits corresponding to each number of block divisions N actually used. To implement this, a unit for setting the number of block divisions N is provided. This N-setting unit is provided as information for setting the shape of a block such as the number of vertical and horizontal pixels, the number of divisions of the screen, or a selection of block shapes prepared in advance.

At the same time the memory access described above is made, the signal characteristics of a received image signal can be detected. When the maximum value of each block is detected as the signal processing characteristics, the memory access address can be used to determine the block to which the pixel belongs. By incrementing the counter in synchronization with the image signal received sequentially, one line at a time, for each screen, the pixel position can be identified by the count value. One counter for the whole screen, or two counters for vertical and horizontal directions, may be used. In either case, by comparing the count value of a received pixel with the count value corresponding to the block division position, the block to which the pixel belongs can be identified. The maximum value of the block is detected for use as the normalization coefficient. For an 8-bit pixel signal, the maximum value ranges from 0 to 255.

Normalization processing based on the normalization coefficient for a detected block is executed by dividing the pixel signals in the corresponding block by the normalization coefficient. The pixel with the maximum value in the block is set to 1.0 during the normalization processing, and the other pixel signals are set to a decimal smaller than 1.0. Each signal can be multiplied by an appropriate coefficient to convert it to an integer binary signal. For example, the signal can be multiplied by 255 to produce an 8-bit binary signal.

Through the normalization processing, a received 8-bit pixel signal is converted to the 8-bit normalization coefficient of a block and the 8-bit normalized signal of a pixel.

The circuit may also be configured so that the result of the signal processing is output in parallel.

In another configuration, the result of the signal processing can also be output as a serial bit stream based on an appropriate format.

In still another configuration, a parallel-to-serial signal conversion circuit may also be provided externally. For example, a parallel-to-serial conversion circuit and a serial transmission interface circuit, known as an LVDS, can be combined.

(6) Signal Processing Using Normalized Signals

The signal characteristics of the normalized signal can be improved by performing two-dimensional, temporal interpolation.

Figure 21:
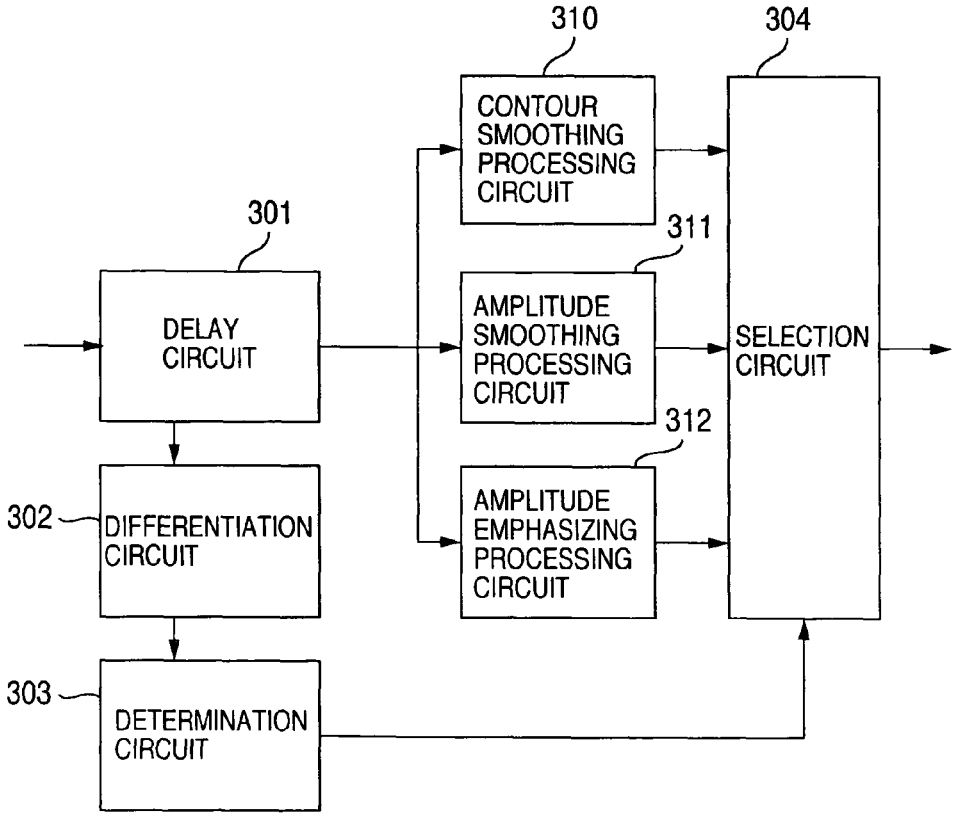
FIG. 21 is a diagram showing the concept of gradation.

With reference to FIG. 21, the configuration of a signal processing circuit will be described which converts the RGB input signals, each composed of eight bits, to the normalization coefficient and the normalized signal for each screen, performs interpolation for improving the gradation characteristics of the normalized signal, and transmits the signal to the next stage.

The color signal C (C is one of RGB) is received and accumulated in a delay circuit 301. To perform screen-basis signal processing, the delay circuit 301 must have at least one screen of capacity. To allow for the circuit operation, multiple line memories may be provided to temporarily store the input signal.

The input signal and the signals in the corresponding positions already accumulated in the delay circuit are referenced to identify multiple temporally and two-dimensionally neighboring pixel signals. For example, a differentiation circuit 302 is used to extract the signal characteristics, a determination circuit 303 is used to determine the extracted signal characteristics and, based on the determination result, a selection circuit 304 is used to select signal processing for improving the image quality. For example, the neighboring pixel signals usually have high correlation. Using this property, a contour smoothing processing circuit 310 is used to smooth the contour, an amplitude smoothing processing circuit 311 is used to increase the number of gradations for correcting the signal, or an amplitude emphasizing processing circuit 312 is used to emphasize the edge. Those circuits can be selected according to the signal characteristics of the input signal. The output of the selection circuit 304 can be output as the corrected normalization coefficient and the normalized signal that have been corrected.

As a correction processing method for increasing the number of gradations, a function that fits the signal of the notice pixel and the signals of multiple pixels neighboring the notice pixel is used to calculate the signal value. This method estimates a feeble signal, which is not sampled at notice pixel sampling time, with the use of the fitting function and reproduces a signal whose variations are smooth. As a simple fitting function, an average operation for averaging pixels including neighboring pixels or a low-pass filter operation can be used. For example, by referencing a 3×3 pixel area where the notice pixel is in the center, each of the pixels is multiplied by a weighting factor corresponding to the pixel position, the results are added up, and then the addition result is divided by the number of pixels. The weighting factor or the fitting function can be adaptively changed based on the signal distribution in the pixels to be referenced. Note that the neighboring pixels to be referenced are not only those in the screen but also those that are temporarily neighboring. That is, a signal reproduction method for the three-dimensional space (plane and time) can be used.

As described above, the present invention provides a method for processing an image signal in the normalization representation; for example, the method can increase the image quality by increasing the number of gradations. Because the display device displays an image as a combination of the normalization coefficient and the normalized signal, an increase in the number of gradations in the normalized signal has an effect of displaying a signal of gradations more than that of a received image signal.

Sixth Embodiment

Apparatus Configuration

The configuration of an apparatus, which uses two types of signals (that is, normalization coefficient and normalized signal) in normalization representation according to the present invention to transmit and display the image signal, is applicable to many products such as a television set, a personal computer, a game machine, and a computer graphics device. Note that, in addition to an increase in the image quality of a display output, the image quality can also be increased during image signal generation and signal processing. For example, though the number of gradations per pixel is usually 8-12 bits, the present invention represents the number of gradations using a combination of two types of signals (normalization coefficient and normalized signal) for image signal generation and signal processing to increase the image quality. For broadcasting, a broadcast station performs image signal generation and signal processing for increasing image quality and transmits the signal to a receiver side. Thus, the receiving side can greatly increase the image quality of the display output with no significant increase in the amount of signal processing.

The following describes the effect of the present invention application in an actual device configuration.

(1) Application to Television

Figure 22:
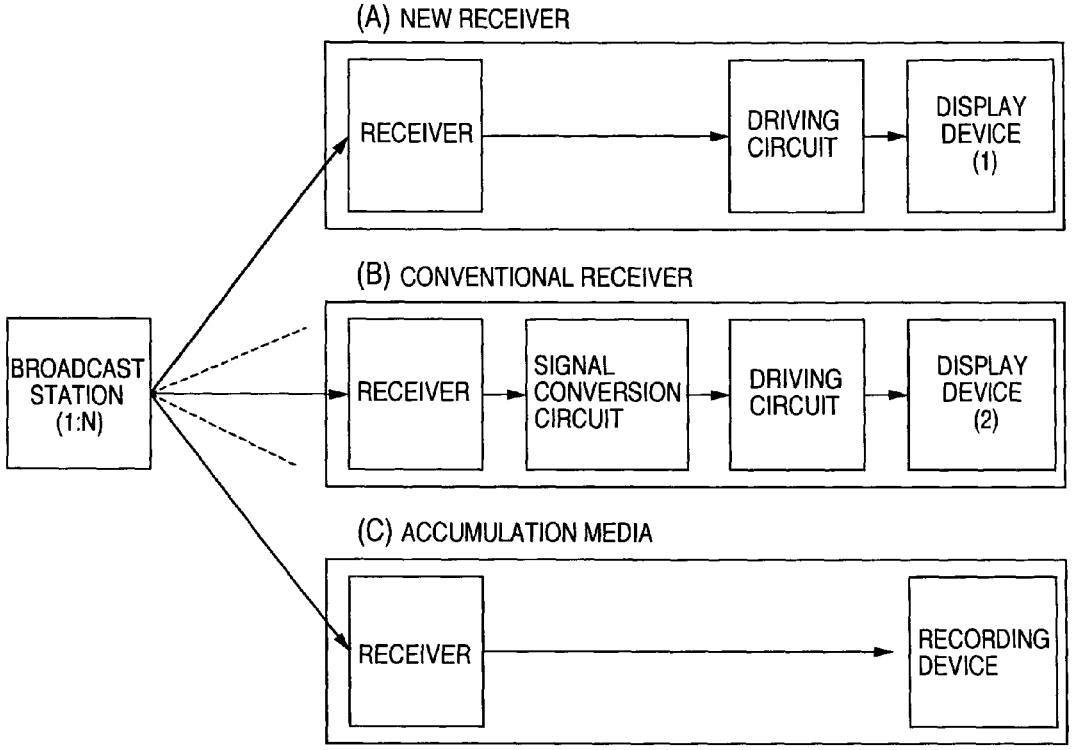
FIG. 22 is a diagram showing the configuration of a device that transmits and accumulates a broadcast signal.

FIG. 22 shows the configuration of a device that transmits a combination of two types of signals (normalization coefficient and normalized signal) as the broadcast signal from a broadcast station. A broadcast is defined here as a 1-to-N data transmission in which data is transmitted from one transmitter to an unspecified number of receives. For the broadcasting type, a radio wave, a copper wire, or an optical fiber can be used efficiently as the transmission line for serial transmission. This is because a delay is sometimes caused by the transmission means when transmitting a signal to a remote location and, in a parallel transmission configuration where multiple signal lines are used, the configuration tends to become complicated to solve the problem of a variation (skew) in signal arrival. In former days, pre-processed image data is transmitted assuming that the data will be displayed on a CRT that was the only display device in those days. However, this assumption is not true because various types of display devices based on various principles are now available. In addition, the receiving side sometimes processes the signal to increase image quality. An increased diversity in the receiver device configuration and the purpose described above requires versatility in broadcast transmission data. To meet this requirement, a unit of normalization representation, that is, the divided area of the light emission means of the backlight, is set to a relatively small area to allow the receiving side to reconfigure the unit of normalization easily and thus to flexibly configure the receiving side device. The present invention is characterized in that the image signal is serially transmitted in the normalization representation format via a broadcast or a communication line. As compared with the conventional output method in which only one signal is used, the receiving device side can display higher-quality data.

In a mutual communication environment, the transmitting side and the receiving side can prepare a device-ability negotiation procedure and, based on the negotiation result, can set a method for creating transmission image signal.

FIG. 22A shows a device configuration in which image data is transmitted from a broadcast station as a broadcast signal composed of a combination of the normalization coefficient and the normalized signal and then the receiver side converts the two types of signal to the two types of driving signals for display on the display apparatus according to the present invention.

FIG. 22B shows a device configuration in which image data is transmitted from a broadcast station as a broadcast signal composed of a combination of the normalization coefficient and the normalized signal and then the receiver side converts the two types of signals to the conventional one type of image signal and, after that, to the driving signals for display on the conventional display device. The present invention provides signal conversion means for displaying on the conventional display to broadcast an image signal regardless of the type of the receiver. A high quality image is displayed on a new display according to the present invention, while a conventional quality image is displayed on the conventional display. In this way, the present invention makes it easy to move to the new broadcast signal while providing a signal conversion unit for the conventional display to maintain compatibility.

FIG. 22C shows a device configuration in which a received image signal is once recorded and accumulated in accumulation means such as a semiconductor memory, a DVD (Digital Versatile Disc), and an HD (Hard disk). When an image signal is recorded and accumulated, the normal representation is also used for the signal to be used to increase image quality.

(2) Application to PC Device Configuration

Figure 23:
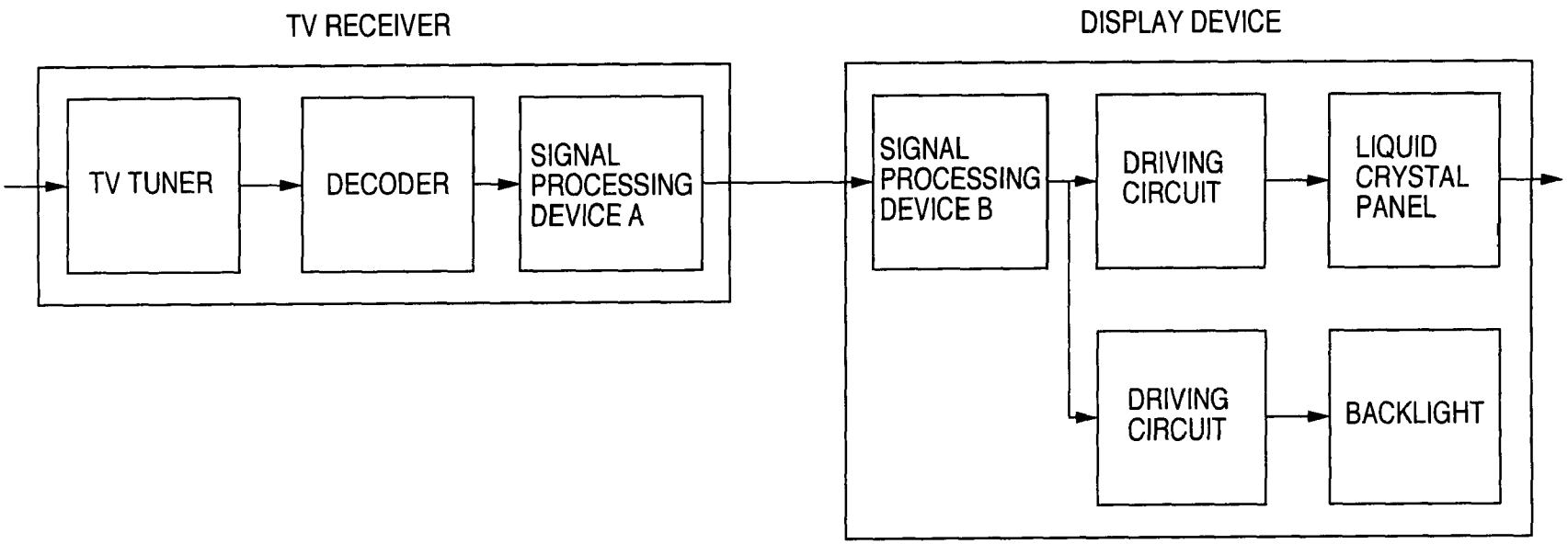
FIG. 23 is a diagram showing the configuration of a personal computer that generates and displays image data.

With reference to FIG. 23, the following describes the use and the effect of the image data representation method according to the present invention used in the device configuration of a personal computer that generates and displays image data. In general, a personal computer cabinet includes a CPU, a maim memory, a graphics board, and so on. The graphics board includes a graphics processor, a graphics memory, and a display output circuit for drawing processing. The CPU, the main memory, and the graphics board in the personal computer system unit work together for operation. A program for controlling the operation is configured to maximize the capability of those signal processing devices to perform high-speed drawing processing. The graphics processor writes image data, generated or obtained from an external device, into a graphics memory and outputs it to an external display device at a correct time. An existing graphics processor outputs the image data as RGB color signals each composed of eight bits. The size of a screen in the graphics memory is set to match the number of display pixels of the display device. The RGB signals are sequentially scanned and output in synchronization with the display device operation.

The display apparatus includes a display device and a circuit for driving the display device. The display device combines the three color (RGB) display elements to form one pixel, arranges the pixels two-dimensionally to form a screen, and outputs a display by repeatedly rewriting the screen.

The present invention is characterized in that the image data A is generated in the form A=B×C+D or A=B×C. Any generation method can be used for generating the data format. For example, it may be obtained as a result of operation of the CPU or the graphics processor of the graphics board according to the procedure described in a program.

In the present invention, the image data A is transmitted in the format A=B×C+D. The present invention provides one of the following means to provide a signal line, a data format, or a transmission time for transmitting the new data C and D.

(1) Replace the signal of a specific pixel in the screen.

(2) Use undefined bits, if any, in the data format or the signal line.

(3) Use a meaningless time, if any, in the transmission time.

In the device configuration where there are a personal computer and a display, the personal computer receives and processes the TV signal and outputs the data B and C described above. In response to B and C, the display controls the transmittance of a pixel via the B driving unit and controls the backlight via the C driving unit.

The operation is performed in the personal computer as follows. The TV signal is received via a special circuit such as a TV tuner, and the received data is processed as pixel-based bit map data to allow the bit map data to be processed like other received or generated image signals. One screen of image data is processed as array data composed of pixel data with the vertical and horizontal axes as the coordinates. Any color signal type, RGB or YUV, may be used. For example, when YUV is used, it is possible to set the sampling rate so that the sampling rate differs among YUV. The signal of image data can be measured easily; for example, the maximum/minimum, average, histogram, or chromaticity can be obtained as a measurement result. This measurement result gives a measurement result of the signal characteristics of image data for each frame of a received TV screen and, based on the measurement result, allows signal processing to be performed under program control. For example, the normalization coefficient and the normalized signal can be calculated as a result of normalization processing using the maximum value and the minimum value. Data obtained as the measurement result data and image data to be measured are placed in the memory to which the program accesses. This memory may be a so-called personal computer main memory, a processor LSI internal memory, or a graphics board memory. The data flows as follows. First, image data received by the TV reception circuit is written into the memory, the signal of the image data read from the memory is measured by the program-controlled processor, the signal of the image data read from the memory is processed by the program-controlled processor, the result of the signal processing is written into the memory again, and the image data is read from the memory for output based on the external output time.

As described above, the present invention is characterized in that image data that is output externally is a combination of the normalization coefficient and the normalized signal. The image signal used for this processing may be generated in the personal computer or may be a TV signal received by the TV tuner as described above. Thus, one screen of image signals is composed of the normalization coefficient and the normalized signal and those signals are output externally. For example, if the received image signal is an RGB color signal each composed of eight bits and each pixel is composed of 24 bits, the image signal can be replaced by the normalization coefficient and the normalized signal while still maintaining the data structure of the image signal. That is, the normalized signal and the normalization coefficient according to the present invention can be output externally via the output unit and the transmission cable for outputting the conventional RGB image signal.

In this way, image data, which is separated into the normalization coefficient and the normalized signal according to the present invention, can be output via the so-called graphics board while maintaining the conventional physical and electrical characteristics of the signal interface.

The display device, which receives the image signal, also receives the normalization coefficient and the normalized signal according to the present invention for outputting on the display device while maintaining the conventional physical and electrical characteristics of the signal interface.

The present invention comprises means for negotiating the setting of the image signal. In the description below, assume that the personal computer and the display device negotiate each other. In the usual operation, the image signal is transmitted in one direction, from the personal computer to the display device. The present invention provides means for negotiating the transmission format before starting this usual operation. After confirming the setting of the transmission format of the signals B, C, and D between both sides, the usual operation is started to transmit data. Although the USB (Universal Serial Bus) known as a general-purpose interface for device connection can be used as the means for negotiation, the personal computer and the display device can be wired for negotiation. Alternatively, the operator can manually set the characteristics of both devices for negotiation.

(3) Application to PC software Configuration

The following describes the use and the effect of the image data representation of the present invention in a personal computer device configuration in which image data is generated and displayed. There are two types of image signals processed by the personal computer: TV reception image signal received from an external source and image signal generated by the personal computer. The former is an image signal with the same characteristics as those of a standard TV set. The latter is the signal of a screen such as a game screen generated by image generation software such as OpenGL and DirectX. In either case, the image signal can be accumulated in the memory for signal processing by a program.

Figure 24:
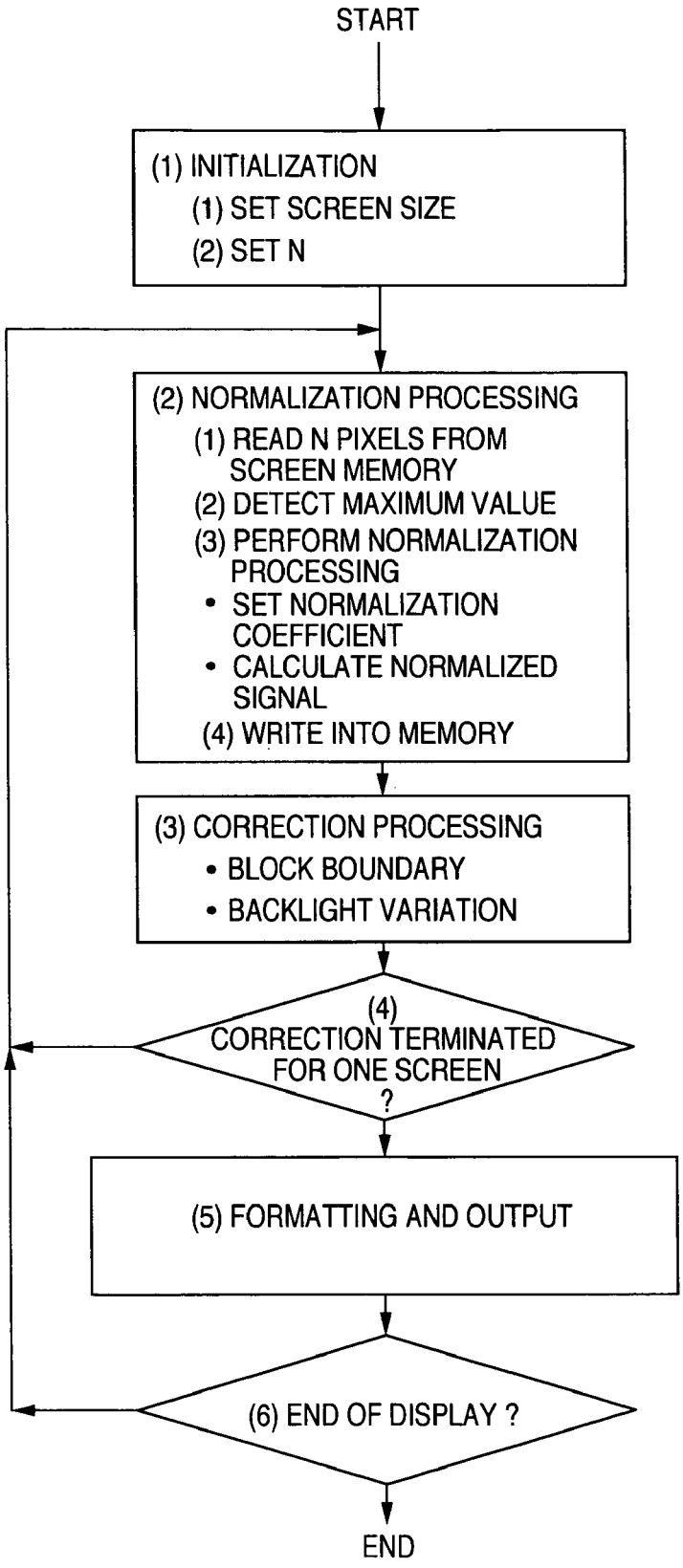
FIG. 24 is a diagram showing an example of a procedure for normalization processing.

FIG. 24 shows an example of the procedure for normalization processing.

(1) First, initialize the parameters for signal processing. For example, the screen size is specified to set up the format of the image signal to be received from an external source and to be output to an output device. The number of pixels, N, is set as the pixel block shape to be used for normalization.

(2) Next, perform normalization processing for the image signals accumulated in the memory. More specifically, the following steps are executed: (1) Read N pixels from the screen memory, (2) Detect the maximum value, (3) Perform normalization processing (set normalization coefficients, calculate normalized signal), and (4) Write into the memory. Those steps are described in the program for execution by the CPU (processor in the personal computer) or the GDP (graphic display processor).

(3) Perform correction processing for the normalization coefficient and the normalized signal calculated in (2) above. The correction processing is performed for a variation in the amount of backlight that leaks from the block boundary, reflected light from an external light source, and the brightness dependent on the temperature of the backlight. Those variation amounts can be corrected using a value detected by a sensor.

(4) Sequentially execute the steps while checking if signal processing has been terminated for each pixel block included in one screen. Although made for one screen in this flowchart, the termination checking can be made for a pixel area smaller than one screen or for multiple screens.

(5) After the normalization processing and the correction processing are completed, shape the normalization coefficient, the normalized signal, and the other additional signals according to the predetermined format and output those signals. For example, when a standard graphics board is used as the output means, the screen data can be set. Therefore, the normalization coefficient, the normalized signal, and the other additional signals are written and output using the format of the screen data.

(6) Check if the procedure is terminated.

(4) Application to Image Signal Generation Device (Floating-Point Representation and Normalization Processing)

The following describes that an image signal in the normalization representation using two types of signals (normalization coefficient and normalized signal that have been used in the description of present invention) can be replaced by an image signal in the floating-point representation as well as its merit brought about by the replacement. In general, a numeric value in the floating-point representation, if used in the signal generation procedure in the technical field of computer graphics, sometimes prevents a loss in the number of effective gradations during calculation. In the present invention, a signal represented as a floating-point number can be received for driving the display device to increase the display dynamic range and the number of effective gradations.

When a floating-point numeric value is represented as $A=B\times10\hat{}C$, the mantissa C represents the decimal digit position and the exponent B represents an effective number where the signal range changes depending upon the setting of C. The setting of C need not always be an exponentiation of 10 but can be replaced by any numeric value. Meanwhile, the normalization representation is a representation method in which "$10\hat{}C$" is replaced by the maximum value of the signal amplitude. Although a procedure for detecting the maximum value of the signal amplitude is required, the effective number B can be used in the full range of 0 to 1. If the mantissa in the floating-point representation is set equivalent to the normalization coefficient in the normalization representation, both representations are the same. That is, an image signal in the floating-point representation and an image signal in the normalization representation can be converted between them easily.

The two types of signals (mantissa and exponent) in the floating-point representation and the two types of signals (normalization coefficient and normalized signal) obtained through normalization processing are similar in the data format. Therefore, the floating-point representation of an image signal and the normalization representation of an image signal can be treated equivalently in data transmission and accumulation.

In addition, the floating-point representation of an image signal and the normalization representation of an image signal can be treated in the same manner when a display apparatus is driven. The driving signals of the LCD panel and the backlight, which constitute the display apparatus according to the present invention, are composed of the normalized signal that drives the LCD panel and the normalization coefficient that drives the backlight, and those signals work together to give a display output as described above. Similarly, the exponent of the floating-point expression is used to drive the LCD panel, the mantissa of the floating-point expression is used to drive the backlight, and both are combined to give a display output. As compared with a display output when an image signal is received in the fixed-bit format, an image in the floating-point format has a merit that the display dynamic range and the number of effective gradations are increased.

The transmitting side of an image signal can also convert the image signal from floating-point representation to normalization representation and transmit the signal in the normalization representation, in which case the device configuration is as described above. The transmitting side and the receiving side can prepare a negotiation procedure for setting the signal representation format so that the configuration can be built to allow high-quality image to be displayed according to the device capability of both sides.

Of course, some data compression can be performed for an image signal to be transmitted. In the present invention, the two types of signals (normalization coefficient and normalized signal) in the normalization representation can be compressed separately or those signals are mixed and compressed at a time.

Figure 25:
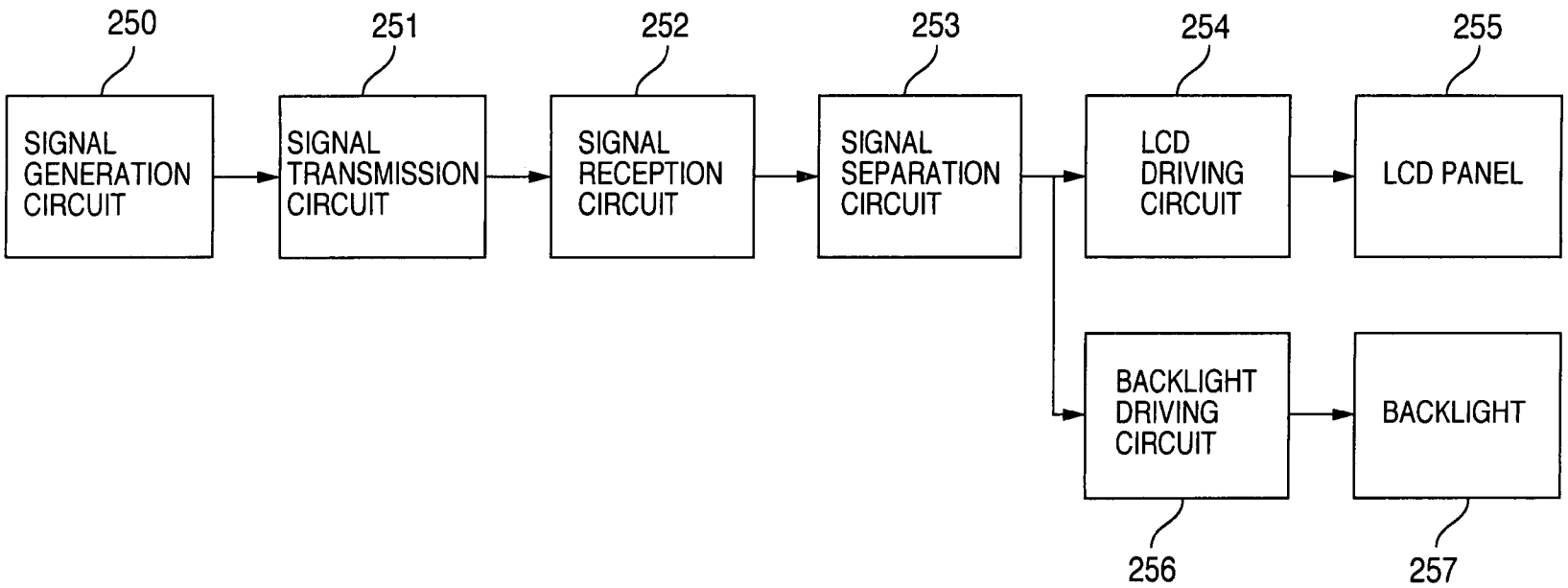
FIG. 25 is a diagram showing an example of the configuration of a display that uses a signal in the floating-point numeric representation format.

FIG. 25 shows an example of the configuration of a display device that uses a signal in the floating-point numeric representation format.

A signal generation circuit 250 generates the image signal of each pixel in the floating-point numeric representation format. A signal transmission circuit 251 shapes the floating-point image signal into a frame-based format and outputs it. A signal reception circuit 252 receives the floating-point image signal and uses a signal separation circuit 253 to separate the signal into the two types of signals (exponent and mantissa). An LCD panel driving circuit 254 uses the exponent signal described above to generate the driving signal of an LCD panel 255. A backlight driving circuit 256 uses the mantissa signal described above to generate the driving signal of a backlight 257. The both generated driving signals are used to drive the LCD panel and the backlight to give a display output. In this way, the present invention uses the floating-point numeric representation format of an image signal to increase the display dynamic range and the number of effective gradations. In this case, each pixel can be composed of the exponent and the mantissa in the floating-point numeric representation format; not only that, multiple pixels can share the mantissa because an image signal tends to have a high correlation with a neighboring pixel. Sharing the mantissa reduces the amount of necessary data. Any area of multiple pixels may be shared. An area to be shared can be set based on the divided areas of the light emission unit of the backlight.

The display device receives the floating-point image signal described above and, for each divided area of an appropriate size, normalizes the received image signal into the normalization coefficient and the normalized signal according to the signal amplitude value in the area; those normalized signals are used as the driving signals of the LCD panel and the backlight. The divided area can be set depending upon the arrangement configuration of the light emission unit of the backlight. When the backlight has a light emission distribution that is even all over the areas, the screen can be treated as one area or can be divided into multiple blocks. The amount of data can be reduced by setting the mantissa or the normalization coefficient for each divided area.

The image signal can be processed considering the gamma characteristics of the image signal. For example, if the received signal is converted by the gamma characteristics during execution of the procedure for calculating the average of two pixels, the gamma characteristics inverse conversion can be performed before calculating the average and the gamma conversion can be performed again for producing the output signal.

Meanwhile, a computer graphics data generation technology is available to represent an image signal in the floating-point format. For example, the Graphics Processing Unit (GPU) on the graphics board of a personal computer internally processes the image signal in the floating-point format. This floating-point format is converted to a fixed-bit numeric format before being output on an existing display. The device configuration described above is applied to a personal computer as follows. The processor and the graphics board of the personal computer correspond to the signal generation circuit 250, the output unit of the graphics board corresponds to the signal reception circuit 252, and the display apparatus of the present invention corresponds to the signal separation circuit 253, the LCD panel driving circuit 254, the LCD panel 255, the backlight driving circuit 256, and the backlight 257. The processor and the graphics board of the personal computer can be easily replaced by the signal generation circuit of a game machine, in which case the merit of the present invention can be obtained in the same way.

In the present invention, the image data in the floating-point representation described above is output either directly or after conversion to the normalization representation, and the display apparatus side receives the signal and uses it for the driving signal of the LCD panel and the backlight. This enables a display in a dynamic range wider than that of the conventional fixed-bit numeric representation.

The image signal can be output using the signal format described with reference to FIG. 2. In this case, the conventional signal transmission unit can be used to transmit the signal in the new signal format according to the present invention. Therefore, the conventional signal transmission method can be moved to the signal transmission format according to the present invention while maintaining compatibility.

The display apparatus according to the present invention can perform signal processing such as noise removal, gradation conversion, and gamma conversion for the image signal in the floating-point representation, thus increasing image quality without generating a bit precision problem that might occur during the signal processing of the image signal in the conventional fixed-bit format.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A liquid crystal display apparatus comprising:

a liquid crystal display panel having a liquid crystal layer held between a pair of substrates;

a light source, a brightness of which is controllable;

a normalization processing circuit that converts an image signal to a normalized signal and to a normalization coefficient;

an LCD driving circuit that converts the normalized signal to an LCD driving signal for driving the liquid crystal display panel; and a light source driving circuit that converts the normalization coefficient to a light source driving signal for driving the light source;

wherein the normalization coefficient is used to set pixel values in a blanking interval of a display screen, and the normalized signal is used to set pixel values in a display area of the display screen.

2. The liquid crystal display apparatus according to claim 1, further comprising:

a receiving unit for receiving the image signal; and a separation unit for separating the received signal into the signal for controlling said liquid crystal layer and the signal for controlling said light source.

3. The liquid crystal display apparatus according to claim 1, further comprising a conversion unit for converting the image signal into a serial signal.

4. The liquid crystal display apparatus according to claim 3, further comprising a separation unit for separating the serial signal into the signal for controlling said liquid crystal layer and the signal for controlling said light source.

5. The liquid crystal display apparatus according to claim 1, further comprising:

a storing unit for storing one or more of characteristics of brightness, light emission spectrum, light emission chromaticity, light emission distribution, number of screen divisions, screen division shape, variation characteristics, and external light source characteristics in said light source; and a signal processing unit for performing signal processing for a display signal based on the characteristics.

6. The liquid crystal display apparatus according to claim 1, wherein the liquid crystal display panel is synchronized with the light source, on a frame basis during the display operation, by the LCD driving signal derived from the normalized signal and the light source driving signal derived from the normalization coefficient.

7. A liquid crystal display apparatus comprising:

a liquid crystal display panel held between a pair of substrates and having a liquid crystal layer whose light transmittance can be controlled and a light source, a brightness of which is controllable, wherein the transmittance of said liquid crystal layer can be controlled, M pixels at a time, the brightness of said light source is controllable, N divided areas at a time, light emission distribution characteristics of a display output are detected, said display output being obtained by a combination of the transmittance of said liquid crystal layer and the brightness of said light source, and a transmittance control signal of the M pixels and a brightness control signal of the N divided areas are calculated using the light emission distribution characteristics.

* * * * *